US010518525B2

(12) United States Patent
Parellada Armela et al.

(10) Patent No.: US 10,518,525 B2
(45) Date of Patent: Dec. 31, 2019

(54) PRINTING PLATE CONNECTION SYSTEMS

(71) Applicant: Velcro BVBA, Deinze (BE)

(72) Inventors: Luis Parellada Armela, Girona (GI); Josep M. Soler Carbonell, Girona (ES); Mark A. Clarner, Concord, NH (US); Andrew P. Collins, Bedford, NH (US); Paul R. Erickson, New Boston, NH (US); Christopher M. Gallant, Nottingham, NH (US); David Villeneuve, Bedford, NH (US)

(73) Assignee: VELCRO BVBA, Deinze (BE)

( * ) Notice: Subject to any disclaimer, the term of this patent is extended or adjusted under 35 U.S.C. 154(b) by 125 days.

(21) Appl. No.: 15/324,998

(22) PCT Filed: Jul. 10, 2015

(86) PCT No.: PCT/US2015/040003
§ 371 (c)(1),
(2) Date: Jan. 9, 2017

(87) PCT Pub. No.: WO2016/007892
PCT Pub. Date: Jan. 14, 2016

(65) Prior Publication Data

US 2017/0217157 A1 Aug. 3, 2017

Related U.S. Application Data

(60) Provisional application No. 62/022,889, filed on Jul. 10, 2014.

(51) Int. Cl.

| | |
|---|---|
| ***B41F 27/12*** | (2006.01) |
| ***B41F 30/04*** | (2006.01) |
| ***B41N 6/00*** | (2006.01) |

(52) U.S. Cl.
CPC ..... *B41F 30/04* (2013.01); *B41F 27/1281* (2013.01); *B41N 6/00* (2013.01)

(58) Field of Classification Search
CPC ..... B41F 27/1281; B41F 30/00; B41F 30/04; B41N 6/00
See application file for complete search history.

(56) References Cited

U.S. PATENT DOCUMENTS 2,774,302 A 12/1956 Stromme
3,568,596 A * 3/1971 Mashburn ..... B41F 27/1275 101/415.1

(Continued)

FOREIGN PATENT DOCUMENTS

EP 0279947 A2 8/1988
EP 0279947 A3 8/1988

(Continued)

OTHER PUBLICATIONS

International Search Report and Written Opinion received for PCT/US2015/040003. dated Oct. 1, 2015. 13 pages.

(Continued)

*Primary Examiner* — Jill E Culler
*Assistant Examiner* — Marissa Ferguson-Samreth
(74) *Attorney, Agent, or Firm* — Finch & Maloney PLLC

(57) ABSTRACT

Techniques are disclosed for connecting a printing plate to a print cylinder or surface. The techniques may be implemented, for instance, with respect to a printing plate, a print cylinder, a print sleeve, or some combination thereof. In an embodiment, a field of mechanical fasteners is provisioned on a printing plate, and a complementary field of mechanical fasteners is provisioned on a print sleeve or cylinder. The mechanical fasteners collectively operate to provide a mechanical bond or interface that inhibits lateral and rotational movement of the plate during printing operations, and (Continued)

can also be configured to manage backlash between engaging surfaces of the interface. In some cases, backlash management includes use of cushion effect integral with the mechanical bond itself and/or unidirectional and possibly angled fastener elements to provide a snugging effect. The mechanical bond may be implemented with hook-and-loop, hook-and-hook, hook-to-channel, male/female-type fittings, vacuum, suction, and/or magnetics.

20 Claims, 17 Drawing Sheets

(56) References Cited

U.S. PATENT DOCUMENTS

| | | | | |
|---|---|---|---|---|
| 3,879,835 | A * | 4/1975 | Brumlik | A44B 18/0061 139/46 |
| 5,260,015 | A | 11/1993 | Kennedy et al. | |
| 5,664,302 | A | 9/1997 | Thomas | |
| 5,983,467 | A | 11/1999 | Duffy | |
| 6,125,753 | A | 10/2000 | Praet et al. | |
| 6,318,261 | B1 | 11/2001 | Koelsch | |
| 6,799,511 | B2 | 10/2004 | McLean et al. | |
| 7,108,814 | B2 | 9/2006 | Herrero et al. | |
| 7,516,524 | B2 * | 4/2009 | Provost | A44B 18/0049 24/452 |
| 7,670,662 | B2 * | 3/2010 | Baldauf | D04B 21/02 428/100 |
| 7,716,792 | B2 * | 5/2010 | Clarner | A44B 18/0049 24/442 |
| 8,225,467 | B2 | 7/2012 | Gallant et al. | |
| 8,424,172 | B2 * | 4/2013 | Idrizovic | A44B 18/0061 24/452 |
| 9,210,970 | B2 * | 12/2015 | Collins | B29C 43/222 |
| 9,781,980 | B2 * | 10/2017 | Kheil | A44B 18/0069 |
| 2001/0042471 | A1 | 11/2001 | Randazzo | |
| 2002/0116799 | A1 | 8/2002 | Martin et al. | |
| 2004/0058121 | A1 | 3/2004 | Schriefer et al. | |
| 2004/0194262 | A1 | 10/2004 | Kurtz, Jr. et al. | |
| 2006/0107501 | A1 | 5/2006 | Tremblay et al. | |
| 2007/0261579 | A1 | 11/2007 | Rizika | |
| 2008/0041249 | A1 | 2/2008 | D'Hauwe | |
| 2009/0010735 | A1 | 1/2009 | Gallant et al. | |
| 2009/0211475 | A1 | 8/2009 | Taylor | |
| 2013/0239371 | A1 | 9/2013 | Shepard et al. | |

FOREIGN PATENT DOCUMENTS

| | | | |
|---|---|---|---|
| GB | 2114935 | A | 9/1983 |
| WO | 2016007892 | A1 | 1/2016 |

OTHER PUBLICATIONS

International Preliminary Report on Patentability received for PCT/US2015/040003. dated Jan. 10, 2017. 11 pages.

Flexography. Retrieved from the Internet on Jun. 12, 2014, at URL: https://en.wikipedia.org/wiki/Flexography. 6 pages.

Digital Workflow—Fast Turnaround-Paltes for the Print Industry. Copyright 2014. 3 pages.

McMahon, "Weyerhaeuser's Flexo Printing Facilities Streamline Pre-Press by Switching to New High-Tech Plate Mounting," Siemens Industry, Inc., Oct. 29, 2007. 4 pages.

"Canted-coil springs for Better Sealing Reliability in a Compact Package," BAL SEAL Engineering, Inc. Retrieved from the Internet on Sep. 25, 2014, at URL: https://balseal.com. 1 page.

"DuploFLEX 5 Plate mounting tape solutions for perfect results in 0.55 mm flexoprint," Lohmann Coating, Converting, Customizing. Retrieved from the Internet on Sep. 25, 2014, from URL: https://www.lohmann-tapes.com. 6 pages.

"DuploFLEX 5 What to consider when using DuploFLEX plate mounting tapes," Lohmann Coating, Converting, Customizing. Retrieved from the Internet on Sep. 25, 2014, from URL: https://www.lohmann-tapes.com. 12 pages.

"Magnetic Cylinders and Bases for the Printing Industry," Bunting Magnetics Co., copyright 2006. 24 pages.

"Understanding the difference between cellular foam tape and ChannalBAC," ChannalBAC, Mounting instructions Retrieved from the Internet on Jun. 4, 2014, at URL: https://www.teamflexo.com/pdf/channalbac-mounting-instructions.pdf?x64330. 3 pages.

"Platemounting Tapes for the printing of Flexible-packaging," tesa—Assortment Folder. Retrieved from the Internet on Jun. 13, 2014, from URL: http://www.tesatape.com. 4 pages.

Extended European Search Report received form EP Application No. 15819380.5, dated Jan. 25, 2018. 11 pages.

* cited by examiner

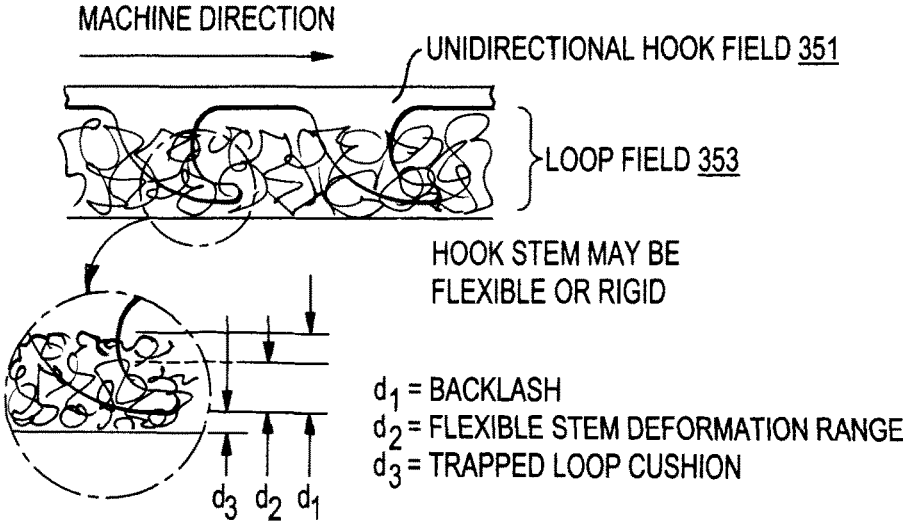
FIG. 3a
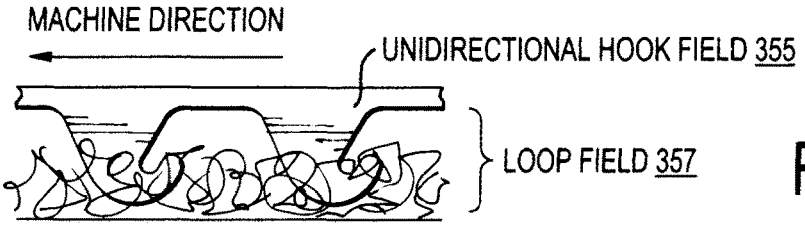
FIG. 3b
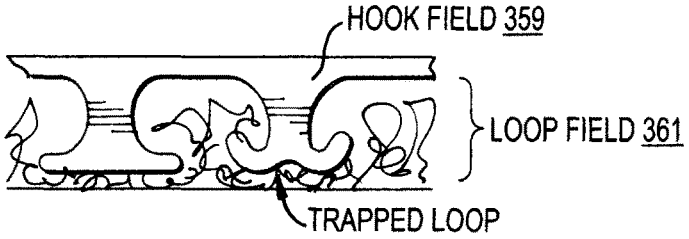
FIG. 3c
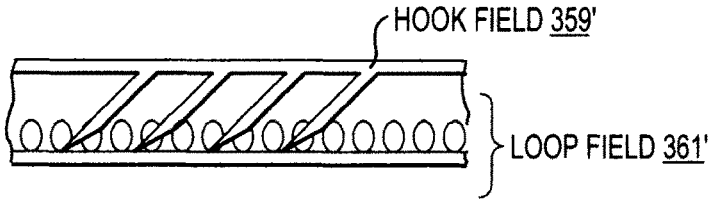
FIG. 3c'
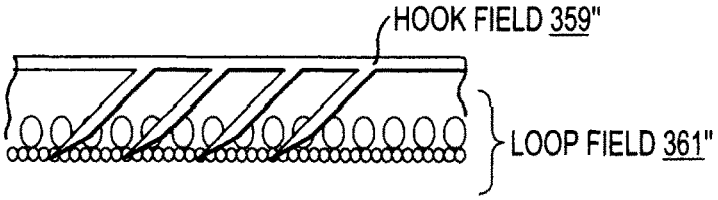
FIG. 3c"

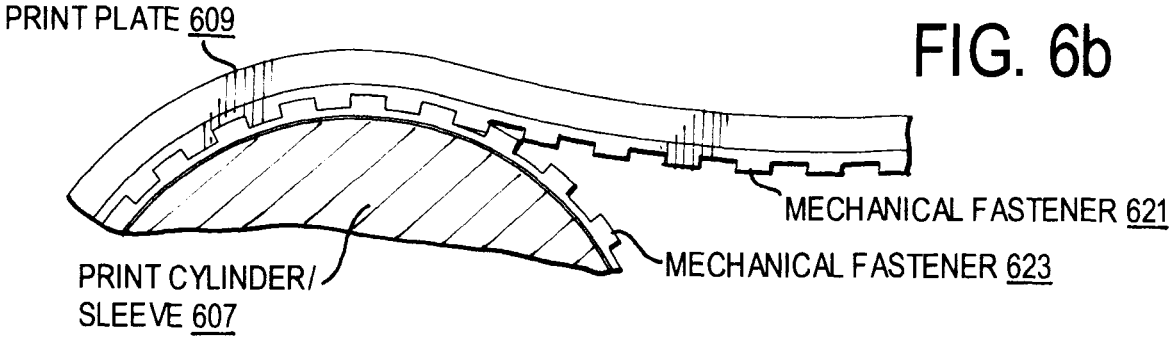
FIG. 6b
FIG. 7
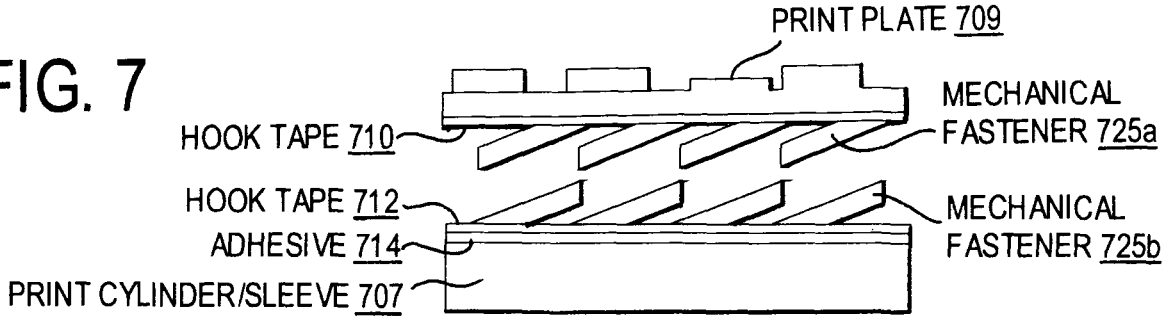
FIG. 8
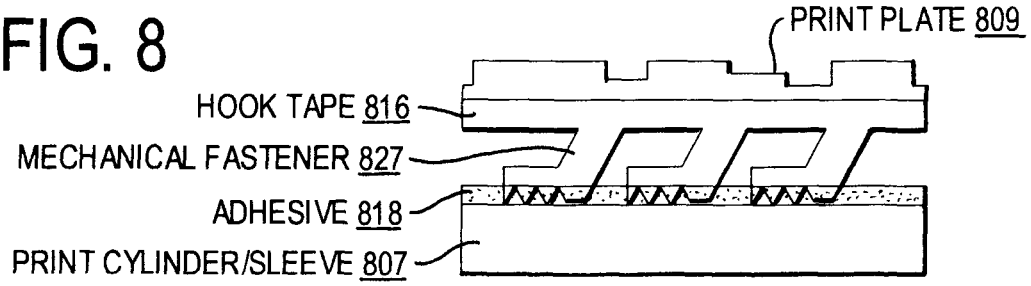

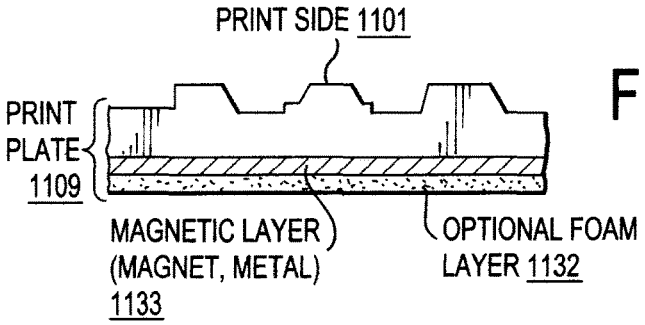
FIG. 11a
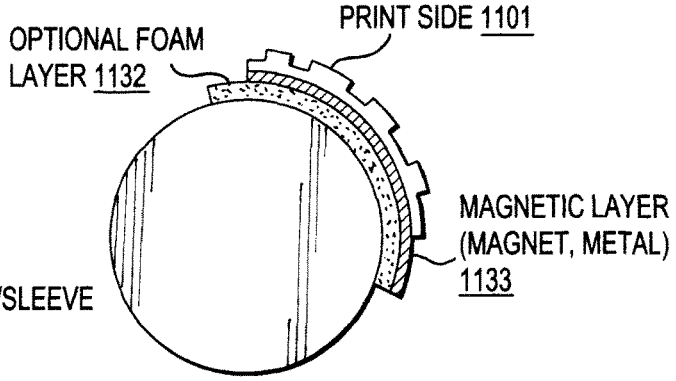
FIG. 11b
FIG. 12a
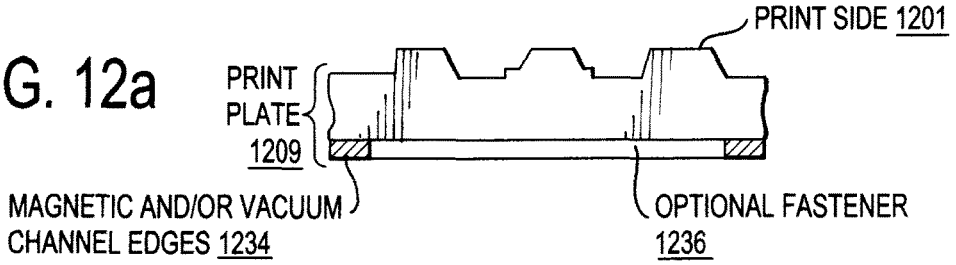
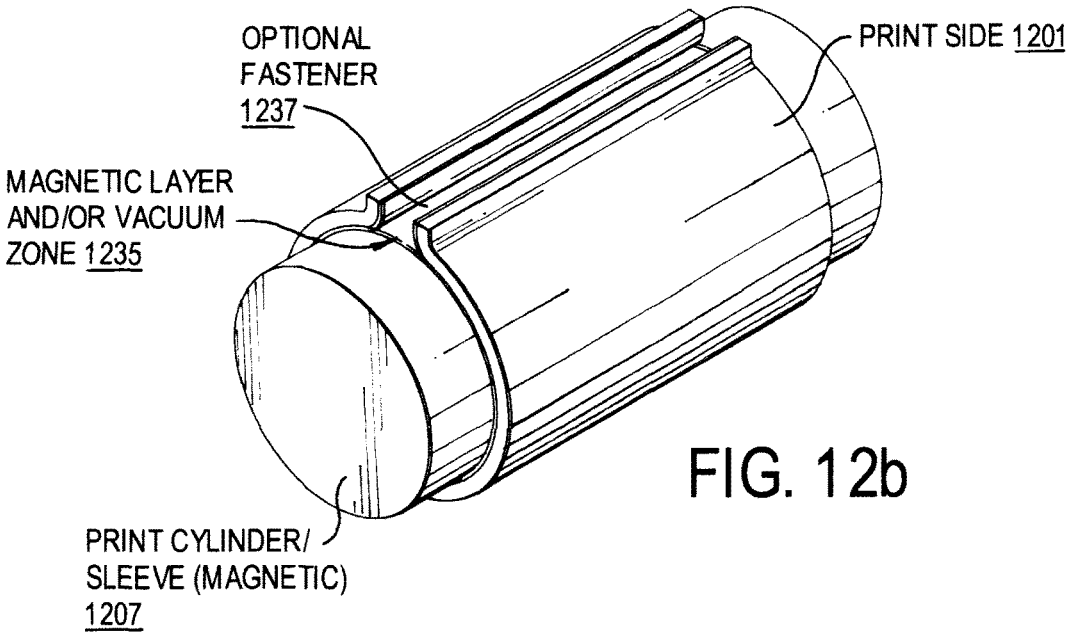
FIG. 12b

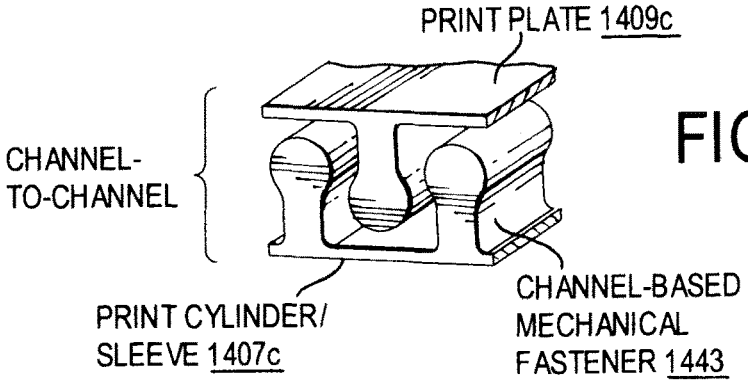
FIG. 14c
FIG. 15a
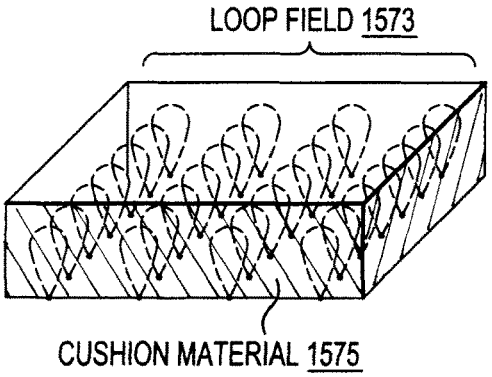
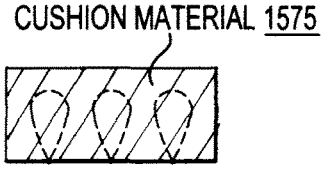
FIG. 15b
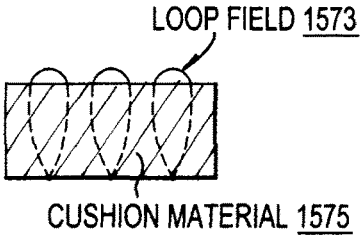
FIG. 15c
FIG. 16
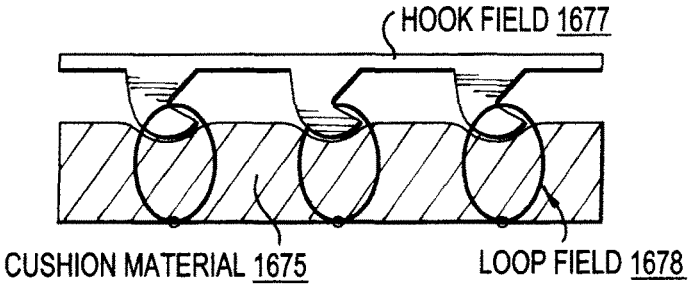
FIG. 17
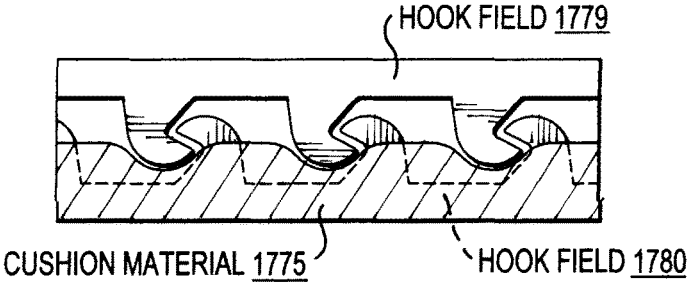

FIG. 20a
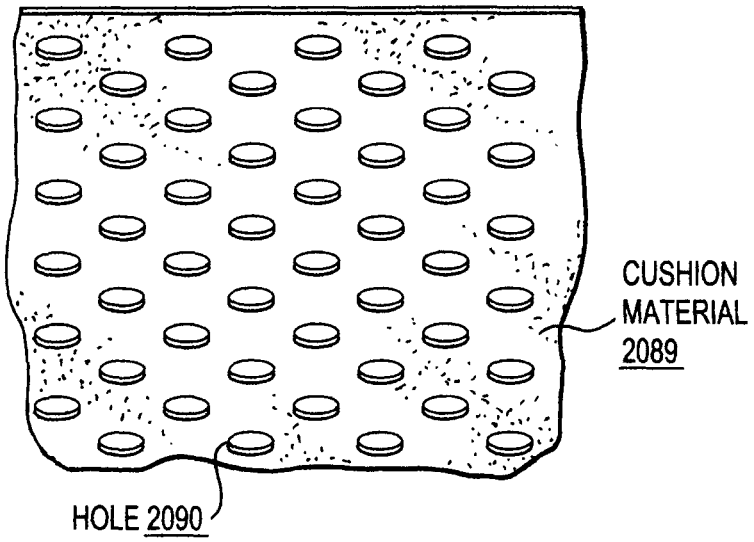
FIG. 20b
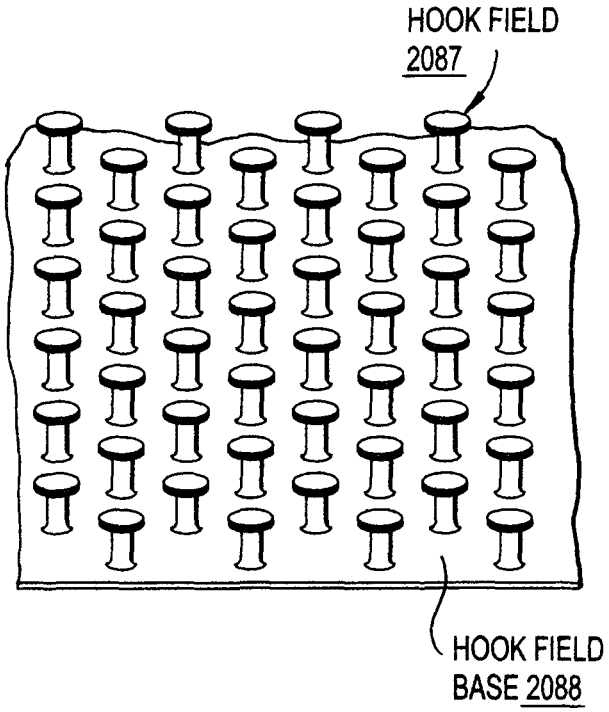
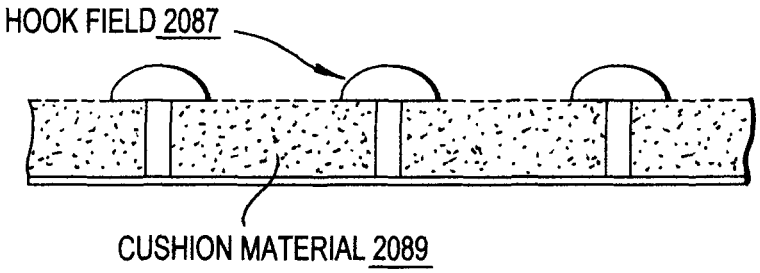
FIG. 20c

PRINTING PLATE CONNECTION SYSTEMS

RELATED APPLICATION

This application claims the benefit of and priority to U.S. Provisional Application No. 62/022,889, filed on Jul. 10, 2014, which is herein incorporated by reference in its entirety.

BACKGROUND

Flexographic printing refers to a machine printing process involving the use of cylinders or rollers to impart a print design onto a print medium. The print medium can be any type of substrate capable of receiving printing ink such as paper, cardboard, plastic, metal film, and packaging material, to name a few examples. The print design can include any desired text and/or graphics, and is provided in relief onto a so-called printing plate. The printing plate is a flexible rubberlike sheet that is attached to a print cylinder of the flexographic print machine. The print plate itself can be made using a mold, or by using a chemical or laser etch process. In a typical mold-based plate forming process, a mold such as a bakelite board is formed with the desired design, and a plastic or rubber compound is then pressed into the mold under pressure and temperature to produce a flexible printing plate. In a chemical-based plate forming process, a mask or film negative embodying the desired print design is placed over a light-sensitive photopolymer plate blank. The masked plate is then exposed to ultra-violet light, such that the photopolymer hardens where light passes through the mask. The remaining unhardened photopolymer is then washed away with an appropriate solvent. In a typical laser-based plate forming process, an image of the desired print design is scanned, computer-generated, or otherwise digitized. A computer-guided laser then etches that image onto a printing plate. Given the attendant print quality and cost effectiveness, photopolymer plates are most commonly used. In any such cases, a printing plate is attached to a given print cylinder using a double-sided adhesive. Some such adhesives include an intervening foam layer, to provide varying degrees of softness. In operation, the raised portions of the resulting printing plate carry ink to the print medium. There are a number of non-trivial challenges involved in attaching a printing plate to a print cylinder.

BRIEF DESCRIPTION OF THE DRAWINGS

FIGS. 3*a-c*" each illustrates a cross-sectional view of a hook-and-loop based print plate mounting system configured in accordance with an embodiment of the present disclosure.

FIG. 3*i*' illustrates a cross-sectional view of the print plate mounting system shown in FIG. 3*i*, in accordance with an embodiment of the present disclosure.

FIGS. 6*a-b* collectively illustrate perspective and cross-sectional views of a gear-based print plate mounting system configured in accordance with an embodiment of the present disclosure.

FIG. 7 illustrates a cross-sectional view of an elastic hook-and-hook based print plate mounting system configured in accordance with an embodiment of the present disclosure.

FIG. 8 illustrates a cross-sectional view of a hook-to-adhesive based print plate mounting system configured in accordance with an embodiment of the present disclosure.

FIGS. 11*a-b* collectively illustrate cross-sectional and perspective views of a magnet-based print plate mounting system configured in accordance with an embodiment of the present disclosure.

FIGS. 12*a-b* collectively illustrate cross-sectional and perspective views of a print plate mounting system configured to inhibit edge peeling of a mounted print plate, in accordance with an embodiment of the present disclosure.

FIGS. 14*b-c* each illustrates a perspective view of a print plate mounting system configured with channel-based mechanical fasteners, in accordance with an embodiment of the present disclosure.

FIGS. 15*a-c* illustrate perspective and cross-sectional views of an example loop-based mechanical bonding surface having an integral cushion effect for use in a print plate mounting system, in accordance with an embodiment of the present disclosure.

FIG. 16 illustrates a cross-sectional view of a hook-and-loop based print plate mounting system configured with an integral cushion, in accordance with an embodiment of the present disclosure.

FIG. 17 illustrates a cross-sectional view of a hook-and-hook based print plate mounting system configured with an integral cushion, in accordance with an embodiment of the present disclosure.

FIGS. 20*a-c* illustrate perspective and cross-sectional views of an example hook-based mechanical bonding surface having an integral cushion effect for use in a print plate mounting system, in accordance with another embodiment of the present disclosure.

Figure 1:
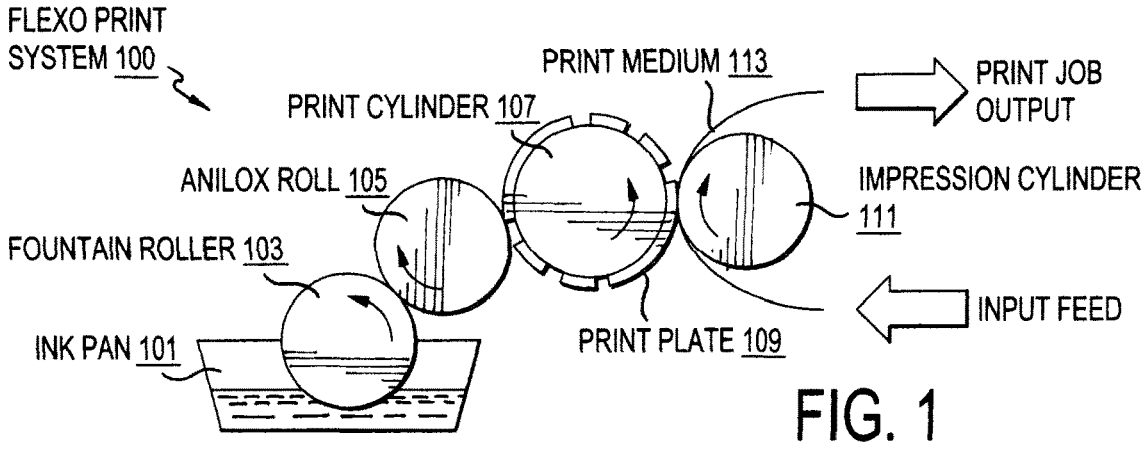
FIG. 1 illustrates a flexography print system configured in accordance with an embodiment of the present disclosure.

Note that the figures are not necessarily drawn to scale. Moreover, the figures are drawn to depict certain features and do not necessarily reflect actual geometries involved. For instance, some of the figures may refer to or otherwise be discussed with reference to cylinders, yet the figures are drawn with relatively flat lines, so as to simplify drafting. Numerous permutations and mixes of the various techniques and features provided herein will be apparent in light of this disclosure.

DETAILED DESCRIPTION

Techniques are disclosed for connecting a printing plate to a print cylinder or sleeve using a mechanical bond. The techniques may be implemented, for instance, with respect to a printing plate, a print cylinder, a print sleeve, or a system including any combination thereof. In an embodiment, a field of mechanical fasteners is provisioned on a printing plate, and a complementary field of mechanical fasteners is provisioned on a print sleeve or print cylinder. The mechanical fasteners collectively operate to provide a mechanical bond or interface that not only inhibits lateral and rotational movement of the plate during printing operations, but can also be configured to manage backlash between engaging surfaces of the interface. In some cases, backlash management includes the use of unidirectional fastening elements (such as unidirectional angled hooks) and/or an engineered cushion effect integral with the mechanical bond itself. The mechanical bond may be implemented, for example, with hook-and-loop, hook-and-hook, hook-to-channel, male/female-type fittings, vacuum, suction, magnetics, interlocking gears, or any combination thereof. The connection system may be further configured to inhibit edge and seam lifting of the plate, and may be implemented in a modular fashion so as to allow for a partial plate change-over. The techniques may be equally applied to any number of other plate-based printing systems, whether cylindrical in nature or otherwise (e.g., flat bed printing presses).

General Overview

As previously explained, there are a number of non-trivial challenges involved in attaching a printing plate to a print cylinder. In more detail, a given plate is normally mounted to the print cylinder using a double-sided adhesive tape. The tape may or may not have an intervening foam layer. During the mounting process, the tape is first applied to the print cylinder. This must be accomplished without trapping any air bubbles between the tape and cylinder. The back-side liner of the double-sided tape is then removed and the plate is carefully attached thereto. The plate must be correctly positioned onto the tape and methodically applied to the cylinder in a rolling fashion, again making sure to avoid any air bubbles between the plate and tape. This is generally a time consuming process. Also, depending on the strength of the tape adhesive, the attached plate can be difficult to remove from the print cylinder and is not reusable if the plate is damaged (e.g., stretched or torn) during removal. Moreover, the tape adhesive tends to leave a residue on the plate and cylinder, which has to be removed prior to attaching a new plate thereby further increasing change-over time. In addition, if the plate is not attached properly due to positioning error or the presence of air bubbles, the resulting print quality may be inadequate (e.g., inconsistent application of ink, unacceptable dot gain, misaligned print features, and failure to adequately print certain features). Furthermore, plates attached using double-sided tape can sometimes exhibit edge peeling along the lateral edges of the print plate and/or along the seam where the ends of the print plate meet, further causing print quality issues, particularly with respect to longer print runs.

Thus, and in accordance with an embodiment of the present disclosure, techniques are disclosed herein for connecting a flexographic printing plate to a print cylinder using mechanical fasteners. The mechanical fasteners operate to provide a mechanical bond or interface that not only inhibits lateral and rotational movement of the plate during printing operations, but can also be configured to manage orthogonal play or so-called backlash between engaging surfaces of the interface. As will be appreciated in light of this disclosure, the techniques may be implemented with respect to a printing plate, a print cylinder, a print sleeve, or a system including a plate-sleeve, a plate-cylinder, or a plate-sleeve-cylinder combination, in accordance with various example embodiments. The mechanical bond may be implemented, for instance, with one or more of the following: hook-and-loop, hook-and-hook, hook-to-channel, male/female-type fittings, vacuum, suction, and magnetics. To this end, the mechanical faster elements can include hook elements, loop elements, channel elements, ridge/groove elements, pin/hole elements, interlocking gear elements, vacuum channels/holes, suction elements, magnets, or any combination thereof. Numerous embodiments and variations thereof will be apparent in light of this disclosure, including both flexographic printing systems and other plate-based printing systems.

In an embodiment, one or more fields of mechanical fasteners are provisioned on a printing plate, and one or more complementary fields of mechanical fasteners are provisioned on a print sleeve or the print cylinder itself (or an adaptor thereof, or so-called carrier sleeve). In some such cases, backlash management includes the use of an engineered cushion effect integral with the mechanical bond itself to reduce backlash, and further to eliminate or otherwise reduce the need for a separate foam layer external to the mechanical bond. In other embodiments, backlash management includes the use of unidirectional and possibly angled fastening elements (such as a field of unidirectional angled hooks) that operate to create a snugging effect during printing operations, thereby reducing backlash. Other configurations may include a mechanical bond having a relatively consistent degree of backlash that operates in conjunction with a separate external foam layer. Still other configurations may include a mechanical bond configured with little or no backlash that can be used with or without a separate external foam layer. Thus, numerous degrees of interface hardness/softness can be provided to support a full range of printing applications. In any such cases, the overall thickness profile of the interface, including any functional layers external to the interfaced surfaces, changes predictably throughout a given printing process, and quickly transitions from a first (compressed) thickness when compressed between print rollers to a second (uncompressed) thickness when not compressed between print rollers. In some such embodiments, note that the compressed thickness and the uncompressed thickness may be substantially the same, depending on the hardness of the interface. The hardness of the interface can be selected based on features of the print design.

In some embodiments, the mechanical fasteners attendant to the mechanical bond are integral with the corresponding printing element, thereby eliminating the need to make an adhesive-based connection between the mechanical fastener medium and the printing element at change-over time. For instance, in one embodiment, a shrink-wrap print cylinder sleeve is configured with mechanical fasteners such as hook and/or loop formed on the outside surface of the sleeve (e.g., using a mold or laminating process, or other suitable forming process). A printer operator can slide such a sleeve onto a given print cylinder (or an adaptor thereon) and shrink the sleeve onto that cylinder with the application of heat. Once the sleeve is securely shrunk onto the print cylinder, its outward facing mechanical fasteners can form a mechanical bond with corresponding mechanical fasteners of the various print plates that may be subsequently installed. In another embodiment, a print cylinder is configured with mechanical fasteners formed on the outer physical layer of the print cylinder itself. For instance, the print cylinder may have a metal or otherwise rigid core with an outer layer of polyurethane or other suitable material that has mechanical fasteners such as hook, loop, channels, ridges, gear elements, and/or vacuum channels formed thereon. In such cases, a print plate having complementary fasteners on its non-print side can be mechanically bonded to the print cylinder. Similar embodiments apply to situations where the print cylinder is modified by a so-called carrier sleeve. As is known, a carrier sleeve can be designed to provide a relatively tight tolerance and can be used as an adaptor to increase print cylinder diameter but at a lower weight/inertia as compared to simply using larger steel cylinders. Thus, a carrier sleeve may be configured with mechanical fasteners just as a print cylinder may. To this end, for purposes of this disclosure, assume that any adaptor or so-called carrier sleeve that can be provided between the print plate and the print cylinder is included in the term print cylinder. In yet another embodiment, a print plate blank can be formed on a one side of a substrate that has mechanical fasteners formed on its other side. In one such example case, the print plate blank can subsequently be processed to have a print design formed on the print side of the plate by using, for instance, a chemical etch process assuming a photopolymer plate blank.

Note that a plate blank configured as provided herein can be selected for a given print design, based on the mechanical fastener arrangement on the non-print side and the cushion effect associated therewith when bonded with a particular mechanical fastener arrangement on the print sleeve/cylinder. For instance, Table 1 allows an operator to select a given plate blank based on the particulars of a given print design. Assume the mechanical fastener arrangement on the print sleeve/cylinder is known. As can be seen in this example print scenario, a hard cushion effect can be used when the print design is substantially dominated with bold/solid design features (lacking in fine details), and a soft cushion effect can be used when the print design is substantially dominated with a mixture of points (exhibiting fine details). A medium cushion effect may be used when both bold/solid and point mixture design features appear in the print design.

TABLE 1

Plate Blank Selection Chart

| Design Type | Plate Blank No. | Cushion Effect |
|---|---|---|
| Bold/Solid | 1 | Hard |
| Combination of Hard/Soft | 2 | Medium |
| Mixture of Points | 3 | Soft |

As will be appreciated in light of this disclosure, such integral mechanical fasteners on the print plate and/or print sleeve or cylinder can greatly simplify the print plate installation process. In one example case, for instance, while the plate may be configured with one or more fields of mechanical fasteners, the print cylinder can be configured with complementary field(s) of mechanical fasteners that can remain on the print cylinder for use with other print plates. So, depending on the particulars of the desired print design, a print plate can be selected that has a mechanical fastener arrangement which will operate in conjunction with the mechanical fasteners on the print cylinder to provide the appropriate cushion effect suitable for that design. For instance, a print design having a multi-color skin tone type image with relatively small features may be better suited for printing with a softer cushion effect, while a print design having one solid color image with relatively large features may be better suited for printing with a harder or minimal cushion effect. Thus, the appropriate print plate blank mechanical fastener arrangement may be one of the only variables requiring consideration at set-up time, which means fewer choices and lower complexity for the printing press operator. Such simplified set-up would be advantageous.

Further note that the mechanical bond may also be configured to effectively self-align during plate installation or otherwise facilitate proper positioning of the plate onto the print sleeve/cylinder, so the operator can quickly and easily conduct a change-over from one print plate to the next. To this end, the interface may include any number of self-aligning features such as pin/hole, ridge/channel, hook/hook, hook/channel, male/female-type elements, and other such arrangements that effectively provide the operator a visual queue or place-holder as to where to place the plate on the print cylinder as well as provide at least an initial holding force while the plate is subsequently wrapped and secured onto the print cylinder. Note that the alignment feature(s) may be part of the mechanical bond and actually provide holding power or may just provide alignment. To this end, the alignment feature(s) may be independent of the mechanical fasteners.

As previously indicated, the mechanical bond can be implemented using any number of mechanical fasteners, including hook elements, loop elements, channel elements, ridge elements, male/female-type elements (e.g., pin/hole elements, ridge/groove elements, press-fittings, interlocking gear elements, other grab elements), vacuum channels/holes, suction elements, magnets, or any combination thereof. In one specific example embodiment, a printing plate includes a field of unidirectional angled hooks facing in a first direction, wherein the hooks engage with loop material of the print sleeve or cylinder. Alternatively, the printing plate may include field(s) of loop designed to engage a field of unidirectional angled hooks provided on the print sleeve/cylinder. In either case, the angle and geometry of the hooks operate in conjunction with the loop material and rotation direction of the print cylinder to provide a snugging effect that inhibits backlash of the mechanical bond. In one specific such case, a second field of unidirectional hooks facing in a direction opposite to the first direction is provided proximate the seam where the ends of the plate meet. Again, the hooks may be provisioned on the plate or the sleeve/cylinder. In another specific example case, the loop is configured with a two-level loop field wherein the shorter loops of the first (lower) level engage the unidirectional hooks and the taller loops of the second (upper) level provide a degree of compressibility or engineered cushion effect once the hooks are engaged with the lower level loops. In another specific example case, a field of loop effectively having one loop level is encased in a foam material. In some such cases, the tips of the loops extend from the top of the foam when the foam is in its uncompressed state, while in other cases the tips of the loops extend from the top of the foam only when the foam is in a compressed state. In either such cases, the bottom of the hooks press into the foam when the hooks engage with the loops, thereby providing a cushion effect that limits backlash. In some cases, the hooks are angled, so as to provide a snugging effect as well, during print operations. In other such example embodiments, the hooks are not angled. In still other such example embodiments, the hooks are not angled or unidirectional. In still other such example embodiments, the hooks are encased in a foam material (partially or completely), rather than the loop.

In another specific example embodiment, a printing plate includes a first field of hooks and the print sleeve or cylinder includes a second field of hooks complementary to the first hook field. The resulting hook-and-hook mechanical bond can be configured with little or no backlash or cushion effect to provide a relatively hard interface, or with an engineered cushion effect integral to the mechanical bond to provide a softer interface. In the latter case, for instance, hooks of one field can be at least partially encased in foam that compresses when the opposing hooks engage as previously explained with respect to a loop field so as to provide a degree of compressibility and a relatively softer interface.

Numerous variations and permutations will be apparent in light of this disclosure, and any number of mechanical fastener types may be used to form a mechanical bond having such an integral cushion effect as provided herein. For instance, magnetic elements may be embedded within a plate body having a foam layer through which the magnetic forces engage a metal print cylinder or sleeve to provide an engineered cushion effect. In another embodiment, vacuum elements may be embedded within a plate body having a foam layer through which the vacuum forces engage a print cylinder or sleeve to provide an engineered cushion effect. Alternatively, the magnet or vacuum elements can be applied directly to the print cylinder or sleeve to provide a relatively harder interface. Still other embodiments may include a combination of vacuum and magnetics. In one such case, the magnetic bond is weaker than the vacuum bond, and allows an operator to readily mount the plate onto a print cylinder and to align accordingly. Once aligned, the vacuum can be engaged. In another embodiment, suction elements may be provisioned on the non-print side of a plate, so that the suction cups engage a print cylinder or sleeve. In any such embodiments, an external layer of foam may also be used to provide a further degree of compressibility, depending on particulars of the print job.

As will be further appreciated in light of this disclosure, the various printing elements may be configured to inhibit edge and seam lifting of the plate. In some embodiments, for example, the density of mechanical fasteners proximate the plate edges/seams can be increased to provide greater holding power in those areas, whereas a lower density of mechanical fasteners can be provided in the central plate area. In other embodiments, a first type of mechanical fastener can be used near the plate edges/seams and a second type of mechanical fasteners can be used to secure other locations of the plate. For example, in one such case, magnets and/or vacuum channels are provisioned along the plate edges/seams while other central parts of the mechanical bond can be provided, for instance, by a hook-hook or hook-loop interface. In another example such case, male-ridges or female-channels can be provisioned along the plate edges/seams while other central parts of the mechanical bond can be provided, for instance, by a magnetic, suction, or vacuum interface. In still other example embodiments, a conventional double-sided adhesive tape (with or without foam) can be used to secure the central portion of the plate, and only the plate edges/seams are configured with mechanical bonding elements. In any such cases, the complementary portion of the mechanical bond can be provided on the print sleeve/cylinder thereby allowing for enhanced or otherwise robust holding power at the plate edges/seams.

As will be further appreciated in light of this disclosure, a given plate may be provided in a modular form, so as to allow for a partial change-over. For example, a portion of a print plate design that is known to wear out quicker than other parts of that design can be modularized or otherwise isolated so that it can be attached and removed as an individual piece, using the same mechanical bonding techniques as provided herein including any enhanced seam/edge bonding. So, a given plate portion can be swapped out from any location on the print sleeve/cylinder, whether it be in a central location of the plate and surrounded by other plate portions, or an edge location. To this end, note that such a modular print plate can be assembled much like a puzzle that includes two or more pieces. For instance, a two piece plate might include two halves or a frame portion and a central portion, while a six piece plate might include four frame portions and two central portions. Any number of plate break-down schemes can be used. Note that such a modular plate scheme allows for self-alignment during partial change-over, given the puzzle-piece nature where one piece can be positioned into place between or otherwise next to already placed pieces. Such self-alignment further facilitates quick change-over times.

Thus, the techniques can be used to provide a stable connection across the complete surface of the print plate, including along the print plate edges and at the seam where the print plate ends meet. Because there is minimal or no use of adhesive to form the mechanical bond, the techniques may further allow for easier re-use of plates as well as easier and quicker changeovers. To this end, further note that there is no need to remove any adhesive residue from the print cylinder or plate, in some embodiments. In addition, while the plate may be configured with one or more fields of mechanical fasteners, the print cylinder can be configured with complementary field(s) of mechanical fasteners that can remain on the print cylinder for use with another print plate (or the same print plate, as the case may be). So, in one particular such embodiment, a desired print design can be initially assessed in advance of transferring that design to a print plate blank so as to determine the best plate blank to use, giving consideration to the cushion effect that will result from the particular mechanical fastener(s) provisioned with that print plate blank and the given print sleeve/cylinder.

Note that, as used herein, the term 'inhibit' is not intended to necessarily mean prevent or absolutely eliminate. Rather, inhibit as used herein generally refers to the ability to minimize or otherwise reduce the ability to do something. For instance, in embodiments where the closure system inhibits edge lifting, the occurrence of edge lifting is either eliminated or otherwise reduced relative to other closures not configured as provided herein. Likewise, in embodiments where the closure system inhibits backlash of the mechanical bond, the occurrence of backlash is either eliminated or otherwise reduced relative to other closures not configured as provided herein. Likewise, in embodiments where the closure system inhibits lateral and rotational movement of the plate during printing, the occurrence of lateral and rotational movement is either eliminated or otherwise reduced relative to other closures not configured as provided herein.

Further note the term 'manage' and its derivatives as used herein with respect to managing backlash generally refers to the intentional changing or manipulation of naturally occurring backlash associated with a mechanical bond. To this end, a managed backlash of a given mechanical bond is different and distinct from the naturally occurring backlash associated with that bond. The difference may be, for example, with respect to a reduction in backlash distance at any given engagement point in the mechanical bond, or at multiple engagement points in the bond, or at all engagement points of the mechanical bond. In some embodiments, at least 50% of the engagement points of the mechanical bond are associated with reduced backlash distance, in accordance with an embodiment. In other embodiments, at least 75% of the engagement points of the mechanical bond are associated with reduced backlash distance, in accordance with an embodiment. In still other embodiments, at least 95% of the engagement points of the mechanical bond are associated with reduced backlash distance, in accordance with an embodiment. In one specific embodiment, 100% of the engagement points of the mechanical bond are associated with reduced backlash distance. As will be appreciated in light of this disclosure, an engagement point is a mechanical fastener element engaging with a complementary fastener element. For example, an engagement point is a hook engaging with one or more loops or perforations, such that the hook needs to be forcibly pulled/peeled to separate from the one or more loops or perforations.

Example Print Systems and Print System Elements

FIG. 1 illustrates a flexography print system 100 configured in accordance with an embodiment of the present disclosure. As can be seen, the system generally includes an ink pan 101, fountain roll 103, anilox roll 105, a print cylinder 107 having a print plate 109 mounted thereon, and an optional impression cylinder 111. In operation, the fountain roll 103 transfers ink from the ink pan 101 to the anilox roll 105. The anilox roll 105 (sometimes called a metering roll) is typically implemented with ceramic material configured with a number of cells that effectively transfer a predetermined amount of ink to the print plate 109 mounted on the print cylinder 107, thereby providing a uniform application or thickness of ink to that plate 109. As known, the number of ink carrying cells per inch of the anilox roll 105 can vary depending on particulars of the print job and the desired print quality. An optional doctor blade (not shown) can be used to scrape the anilox roll 105 to insure that the predetermined ink amount delivered is only what is contained within the engraved cells of the anilox roll 105. The print plate 109 is flexible in this example embodiment so that it can be conformably applied to the print cylinder 107. As can be further seen, an input feed of print medium 113 (e.g., paper, plastic, cardboard, etc) is passed between the impression cylinder 111 and print plate 109 to generate the print job output. Each of the system 100 components can be implemented using conventional technology, except that the plate 109 is fastened to the cylinder 107 using mechanical bonding techniques as provided herein.

Numerous other flexographic and non-flexographic print system configurations can be used, and the present disclosure is not intended to be limited to any particular one. For instance, the print plate 109 may be connected directly to the print cylinder 107, or indirectly via a print sleeve that is shrunk onto or otherwise connected to the print cylinder 107. To this end, various such print system elements may be used to form the mechanical bond. Also, other embodiments may not include the impression cylinder 111, or may include a different roller orientation (e.g., vertical as opposed to horizontal). Likewise, other embodiments may include additional components or stations, such as a dryer for setting or otherwise drying the applied ink(s), or in the case of UV-cured inks, a UV curing station. In a more general sense and as will be appreciated in light of this disclosure, the print plate mounting techniques provided herein can effectively be used on any print system having a print plate fastened to a print cylinder or other print machine surface. As will be further appreciated, the plate mounting techniques can be used with other printing systems as well, such as those having a non-cylindrical printing surface, such as a flat-bed printer that works in conjunction with changeable printing plates. Any number of plate-based printing systems may similarly benefit, such as offset, gravure letterpress, screen, and other such plate-based printing systems.

Figure 2A:
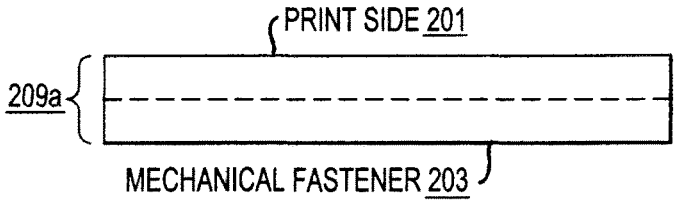
FIGS. 2*a-b* each illustrates a cross-sectional view of a print plate configured in accordance with an embodiment of the present disclosure.

FIG. 2*a* illustrates a cross-sectional view of a print plate 209*a* configured in accordance with an embodiment of the present disclosure. As can be seen, the plate 209*a* generally includes a print side 201 and a mechanical fastener 203 on the opposing side. The mechanical fastener 203 can vary from one embodiment to the next, as will be appreciated in light of this disclosure. The mechanical fastener 203 may be implemented, for instance, with hooks, loops, channels, male/female-type elements, interlocking gear elements, vacuum elements, suction elements, magnetic elements, or a combination thereof.

In some embodiments, the mechanical fastener 203 is integrally formed with the body of the plate 209*a* through an extrusion and/or laminating process, or a three-dimensional (3D) printing process. In one specific example such embodiment, the plate 209*a* is a co-extrusion of photopolymer (to provide the printing surface of side 201) and thermoplastic (to provide the mechanical fastener 203). The thermoplastic can be, for example, polyethylene, polypropylene, nylon, or polyester, to name a few examples. A 3D print process also can be used to form such a structure. Various backing films or intervening material layers can be used to increase interlayer bonding strength, if affinity between photopolymer and mechanical fastener materials is insufficient. In another specific example embodiment, the plate 209*a* is an extrusion or mold of photopolymer or some other suitable material to provide both the printing surface of side 201 and the mechanical fastener 203. In one such case, the plate 209*a* can be formed with mechanical fastener elements embedded or formed in the non-print side surface of the print plate, such as embedded magnets or metal flakes or pieces suitable for use in a magnetic bond and/or surface-formed vacuum channels suitable for use in a vacuum bond, and/or embedded and protruding hooks and/or loop suitable for use in a hook/loop bond. In other such integrally formed embodiments, hook tape or loop tape or a combination of hook-and-loop tape can be used to provide a substrate upon which a print plate is coated or otherwise formed. In non-integrally formed embodiments, the mechanical fasteners can be applied to non-print side of a pre-existing print plate by, for example, a double-sided tape or other suitable bonding technique (e.g., adhesive, thermal or ultrasonic weld).

Example embodiments having a combination of elements making up mechanical fastener 203 include, for instance, a print plate 209*a* having both vacuum and magnetic elements, wherein the magnetic force is lighter than the vacuum force so as to allow for initial positioning of the plate on a given print cylinder or print sleeve using the magnetic force, and the stronger vacuum force can be engaged to lock the plate in position once registered on cylinder. In another example combinational embodiment, elements that can be used to assist not only in securing the plate to print cylinder/sleeve but also in plate alignment and positioning can be provisioned at the edges (along all four edges or some subset thereof) of plate 209*a*. For instance, hook, channel, ridge, groove, and/or other male/female grab-type elements can be used in the two leading corners or along the leading edge of the plate 209*a*, and vacuum, magnetic, hook, and/or loop elements can be provisioned everywhere else. Such alignment features help a printing press operator position and/or initially secure the plate 209*a* to a given print cylinder or print sleeve so as to avoid registration errors, particularly when those guides are formed in a common process that produces both the alignment features and the print pattern features. Further, note that not every portion of the plate 209*a* needs to be bonded. To this end, the mechanical fastener 203 may be a pattern of fasteners or otherwise selectively provisioned on the non-print side of the plate 209*a*, so long as the areas lacking any mechanical fastener don't cause undesired printing issues. The density of mechanical fastener element clusters can be adjusted to meet this goal, as will be appreciated.

In some example cases, print plate 209*a* is a blank plate that has no print design on it; rather, the design can be added at a later time using standard photopolymer chemical etch processing, once the blank plate with mechanical fastener 203 is formed. In other example cases, print plate 209*a* can be formed as a 'ready-to-print' plate that has a desired print design formed on print side 201 as part of the plate forming process. This could be accomplished, for instance, using 3D printing process coupled with a UV curing stage to set the printed design on the print side 201 (assuming a UV cured photopolymer is dispensed by the 3D printer to form the print side 201). Note that by forming the mechanical fastener 203 (including any alignment features) in effectively the same process as the print features of side 201 are formed creates a self-aligning aspect to print plate 209*a* that may help alleviate the potential for registration errors associated with processes that form the print design in a subsequent distinct process after the plate has been formed.

In any such cases, the mechanical fastener 203 may operate in conjunction with a corresponding mechanical fastener of the print cylinder or sleeve to provide a degree of orthogonal play including backlash once the mechanical bond is formed when the plate 209*a* is mounted. The degree of backlash may be small in some cases (such as in the case of hook-and-hook and hook-to-channel mechanical bonds) or relatively large in other cases (such as in the case of certain hook-and-loop mechanical bonds). As will be appreciated in light of this disclosure, left unmanaged or otherwise unacknowledged, such backlash may cause print quality problems, depending on the degree of backlash and the particulars of the given print pattern design.

Figure 2B:
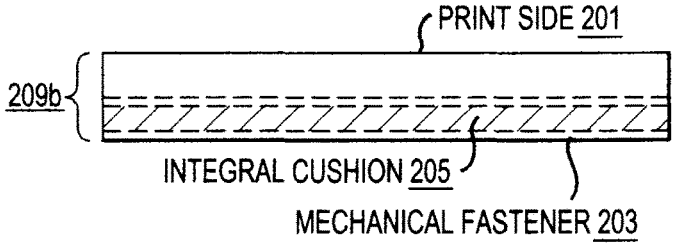

FIG. 2*b* illustrates a cross-sectional view of a print plate 209*b* configured in accordance with another embodiment of the present disclosure. As can be seen, print plate 209*b* is similar to the plate 209*a* and that previously relevant discussion is equally applicable here, but plate 209*b* further includes an integral cushion 205. The cushion 205 may be implemented, for example, with a foam or other such cushion-providing layer sandwiched or laminated or otherwise provisioned between the mechanical fastener 203 layer and a photopolymer layer carrying (or to eventually carry) the print design. In one embodiment, the cushion 205 is implemented with a foam layer deposited over the mechanical fastener 203, so as to at least partially cover the mechanical fastener 203. In still other embodiments, the cushion 205 may be implemented with flexible hook stems included in the mechanical fastener 203, wherein the flexible stems can be angled or otherwise shaped to resistively deform when pressed against the opposing mechanical fastener of the print cylinder. Numerous other schemes to implement integral cushion 205 will be apparent in light of this disclosure.

Figure 2C:
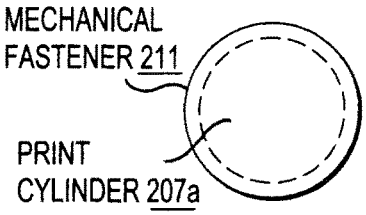
FIGS. 2*c-d* each illustrates a cross-sectional view of a print cylinder configured in accordance with an embodiment of the present disclosure.

FIG. 2*c* illustrates a cross-sectional view of a print cylinder 207*a* configured in accordance with an embodiment of the present disclosure. The print cylinder 207*a* may be made of any suitable material or materials, and includes a mechanical fastener 211 on its perimeter. The mechanical fastener 211 can vary from one embodiment to the next, as will be appreciated in light of this disclosure. The mechanical fastener 211 may be implemented, for instance, with hooks, loops, channels, male/female-type elements, interlocking gear elements, vacuum elements, suction elements, magnetic elements, or a combination thereof. As will be appreciated in light of this disclosure, mechanical fastener 211 works in conjunction with the mechanical fastener 203 to provide the mechanical bond that holds the print plate in position on the cylinder 207*a*.

In some embodiments, the print cylinder 207*a* is a conventional print cylinder, and mechanical fastener 211 is attached to the outer surface of cylinder 207*a* as an add-on component. In one such example case, mechanical fastener 211 is implemented with tape having adhesive on one side and mechanical fastener elements formed on the other side. Again, the mechanical fastener elements on the tape can vary, and may include, for example, hook, loop, vacuum, suction, magnet, gear, channel, or ridge elements or some combination thereof. In any case, the adhesive tape can be wound around cylinder 207*a* to cover a substantial portion of the outer surface (e.g., 50% or more). In some such cases, the tape is spiral wound, which may help further inhibit edge lifting.

In other embodiments, the print cylinder 207*a* is configured with an integral mechanical fastener 211. In one such example case, mechanical fastener 211 is implemented with a plastic or polyurethane layer having mechanical fastener elements formed on its perimeter (via molding, machining, extrusion, 3D printing, or other suitable forming method). The integral fastener layer 211 can be formed, for example, over a print cylinder core or adaptor, having a desired diameter and roundness. Again, the mechanical fastener elements on fastener layer 211 can vary, and may include, for example, hook, loop, vacuum, suction, magnet, gear, channel, or ridge elements or some combination thereof.

Figure 2D:
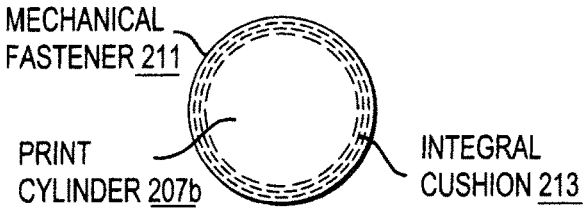

FIG. 2*d* illustrates a cross-sectional view of a print cylinder 207*b* configured in accordance with another embodiment of the present disclosure. As can be seen, print cylinder 207*b* is similar to the cylinder 207*a* and that previously relevant discussion is equally applicable here, but cylinder 207*b* further includes an integral cushion 213. The cushion 213 may be implemented, for example, with a foam or other such cushion-providing layer sandwiched or laminated or otherwise formed between a layer of fastener 211 and a core of the print cylinder 207*b*. In one embodiment, the cushion 213 is implemented with a foam layer deposited over the mechanical fastener 211, so as to at least partially cover the mechanical fastener 211. In still other embodiments, the cushion 213 may be implemented with flexible hook stems included in the mechanical fastener 211, wherein the flexible stems can be angled or otherwise shaped to resistively deform when pressed against the opposing mechanical fastener of the print plate. Numerous other schemes to implement integral cushion 211 will be apparent in light of this disclosure.

Figure 2E:
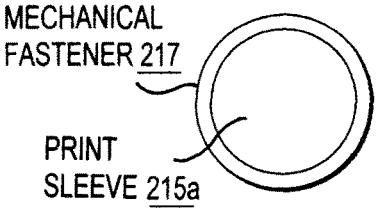
FIGS. 2*e-f* each illustrates a cross-sectional view of a print sleeve configured in accordance with an embodiment of the present disclosure.

FIG. 2*e* illustrates a cross-sectional view of a print sleeve 215*a* configured in accordance with an embodiment of the present disclosure. The print sleeve 215*a* may be made of any suitable material or materials, and includes a mechanical fastener 217 on its perimeter. The mechanical fastener 217 can vary from one embodiment to the next, as will be appreciated in light of this disclosure. The mechanical fastener 217 may be implemented, for instance, with hooks, loops, channels, male/female-type elements, vacuum elements, suction elements, magnetic elements, gear elements, or a combination thereof. As will be appreciated, mechanical fastener 217 works in conjunction with mechanical fastener 203 to provide the mechanical bond that holds the print plate in position on the print sleeve 215*a*, which may in turn be securely mounted on a print cylinder 207.

In some embodiments, the print sleeve 215*a* is a conventional print sleeve, and mechanical fastener 217 is attached to the outer surface of sleeve 215*a* as an add-on component. In one such example case, mechanical fastener 217 is implemented with tape having adhesive on one side and mechanical fastener elements formed on the other side. Again, the mechanical fastener elements on the tape can vary, and may include, for example, hook, loop, vacuum, suction, magnet, channel, gear, or ridge elements or some combination thereof. In any case, the adhesive tape can be wound around sleeve 215*a* to cover a substantial portion of the outer surface (e.g., 50% or more). In some such cases, the tape is spiral wound, which may help further inhibit edge lifting.

In other embodiments, the print sleeve 215*a* is configured with an integral mechanical fastener 217. In one such example case, mechanical fastener 217 is implemented with a plastic or polyurethane layer having mechanical fastener elements formed on its perimeter (via molding, machining, extrusion, 3D printing, or other suitable forming method). The integral fastener layer 217 can be formed, for example, over a print sleeve core, having a desired diameter and roundness. Again, the mechanical fastener elements of mechanical fastener 217 can vary, and may include, for example, hook, loop, vacuum, gear, suction, magnet, channel, or ridge elements or some combination thereof.

In still other embodiments, the print sleeve 215*a* is configured as a heat-shrinkable sleeve having an integral mechanical fastener 217. In one such example case, the print sleeve 215*a* is implemented with a tube of nylon or polyolefin having mechanical fastener elements formed on its perimeter (via molding, machining, extrusion, 3D printing, or other suitable forming method). Again, the mechanical fastener elements of mechanical fastener 217 can vary, and may include, for example, hook, loop, vacuum, gear, suction, magnet, channel, or ridge elements or some combination thereof.

Figure 2F:
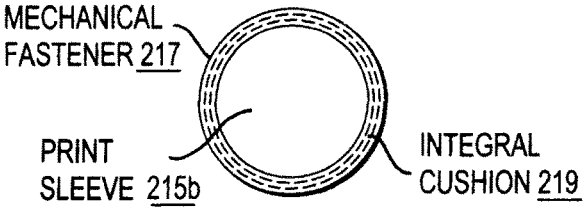

FIG. 2*f* illustrates a cross-sectional view of a print sleeve 215*b* configured in accordance with another embodiment of the present disclosure. As can be seen, print sleeve 215*b* is similar to the sleeve 215*a* and that previously relevant discussion is equally applicable here, but sleeve 215*b* further includes an integral cushion 219. The cushion 219 may be implemented, for example, with a foam or other such cushion-providing layer sandwiched or laminated or otherwise formed between a layer of fastener 217 and a core layer of the print sleeve 215*b*. In one embodiment, the cushion 219 may be implemented with a foam layer deposited over the mechanical fastener 217, so as to at least partially cover the mechanical fastener 217. In still other embodiments, the cushion 219 may be implemented with flexible hook stems included in the mechanical fastener 217, wherein the flexible stems can be angled or otherwise shaped to resistively deform when pressed against the opposing mechanical fastener of the print plate. Numerous other schemes to implement integral cushion 217 will be apparent in light of this disclosure.

In any of the various embodiments disclosed herein, note that it may be useful to employ a slip sheet during the plate mounting process. For example, in some embodiments, a slip sheet may be positioned between the mechanical fastener of the print cylinder/sleeve and the mechanical fastener of the print plate. In general, the slip sheet comprises a material that does not engage with the mechanical fasteners and allows for alignment and adjustment of the print plate on the print cylinder/sleeve prior to engagement of the opposing mechanical fasteners. Once alignment is complete, the slip sheet may be removed thereby allowing the mechanical fasteners to engage and lock the print plate to that selected position. This may be completed in an incremental rotational process that will prevent plate shifting as well as air pockets or wrinkling between the bonding surfaces. In some embodiments, the slip sheet is perforated or otherwise segmented into a number of sub-sheets so as to facilitate its incremental or piecewise removal during the mounting process. In one example case, the slip sheet is segmented into strips that run lengthwise across the print cylinder. The strips can be, for instance, one to three inches wide and delineated with perforation lines. Examples of slip sheet materials may include plastic films, paper, foils or other suitable materials that will prevent engagement of the opposing mechanical fasteners but that can also be slipped out from between those opposing mechanical fasteners.

Example Hook-and-Loop Mechanical Bonds

FIGS. 3*a-c*" each illustrates a cross-sectional view of a hook-and-loop based print plate mounting system configured in accordance with an embodiment of the present disclosure. As can be seen in FIG. 3*a*, the plate mounting system provides a mechanical bond for securing a print plate through the use of unidirectional hook field 351 and a complementary loop field 353. As can further be seen in this example embodiment, the unidirectional hooks 351 are generally angled or otherwise leaning in the machine direction (rotation direction of cylinder during print operations). In such cases, the unidirectional hooks 351 are implemented on the print cylinder or print sleeve and provide a snugging effect. On the other hand, the unidirectional hooks 351 could be implemented on the print plate to provide a similar snugging effect, except that the unidirectional hooks 351 would be leaning in a direction that is generally opposing the machine direction (because the hooks are on the plate rather than the cylinder/sleeve). As will be appreciated in light of this disclosure, the hook field 351 and loop field 353 can each be implemented on either of the print plate or the print cylinder (or print sleeve, as the case may be), and need not be limited to one or the other. Rather, so long as a mechanical bond as provided herein can be formed.

As can be further seen, there is a degree of orthogonal play associated with the mechanical bond. In particular, $d_1$ represents the potential backlash distance of the hook-loop connections making up the bond, if not in a snugged state during print operations. FIG. 3*e* illustrates example backlash of a hook-loop bond. As can be seen, the fully extended hook-loop bond has a distance X associated therewith, and the fully compressed hook-loop mechanical bond has a distance Y associated therewith, wherein the backlash is the difference between the X and Y distance (X-Y). As will be appreciated in light of this disclosure, such backlash $d_1$ can be managed through the use of fastening element direction/geometry and/or engineered cushion effect. In this example case, for instance, the unidirectional hook stems can be made flexible, so that they resistively deform when the hook is compressed into the loop field base, as shown in FIG. 3*a*. $D_2$ represents this deformation distance, which can vary from one hook design to the next. Note, however, that other embodiments may include a rigid hook design, where $d_2$ is substantially zero. As can be further seen with reference to FIG. 3*a*, the hook may trap an amount of loop between the hook end and the loop field base. This trapped loop may provide a further cushion effect, which can be manipulated, for example, by varying loop thickness and/or loop density, so as to provide a desired cushion effect. $D_3$ represents this cushion, and may be relatively low in cases where the hook-loop elements allow the hook to touch the base of the loop field, or relatively high in cases where the loop density/thickness is such that the hook cannot touch the loop field base. In a more general sense, each of the loop and hook designs can be configured to collectively or individually operate to provide snugging and/or cushion effects that limit or otherwise take into account backlash distance $d_1$. As such, a degree of predictable compressibility can be provided, which in turn can be exploited to enhance print quality. Left unmodified or otherwise unmanaged, backlash distance $d_1$ can cause an excessive variance in plate stability and lead to insufficient print quality. Numerous backlash management schemes will be apparent in light of this disclosure.

As can be seen with the example embodiment in FIG. 3*b*, the plate mounting system provides a mechanical bond for securing a print plate through the use of unidirectional hook field 355 and a complementary loop field 357. In this example case, the unidirectional hooks 355 are generally straight (rather than leaning or otherwise favoring a direction as is the case in FIG. 3*a*). In addition, the hooks are generally facing in a direction that is opposite the machine direction. Thus, the hook field 355 can be assumed to be on the print plate and the loop field 357 on the print cylinder/sleeve, in this example case. The previous discussion with respect to FIG. 3*a* regarding backlash distance $d_1$, hook stem deformation range $d_2$, and loop cushion effect $d_3$ equally applies here. Any number of other hook profiles can be used as well, as will be appreciated.

For instance, and as can be seen with the example embodiment in FIG. 3*c*, the plate mounting system provides a mechanical bond for securing a print plate through the use of hook field 359 and a complementary loop field 361. In this example case, the hooks 355 are generally straight (rather than leaning or otherwise favoring a direction as is the case in FIG. 3*a*). In addition, the hooks are generally mushroom or palm-tree or nail-head shaped and double-sided so that the hooks effectively face in all directions (omnidirectional) including both the machine direction and a direction that is opposite the machine direction. Thus, the hook field 359 can be on either of the print plate or print cylinder/sleeve, and the loop field 361 can be on the other. Further note the wider head of such hook styles shown tends to trap more loop, thereby providing a greater degree of cushion effect ($d_3$). This particular cushion effect may or may not be desirable, depending on the desired performance and as will be appreciated in light of this disclosure.

In some example cases, the hook elements are configured to penetrate up to the base of the loop field, or even penetrate through that base and up to the print plate or sleeve ($d_3$ is zero). In some such embodiments, the corresponding loop field is configured with loop spacing sufficient to allow for relatively easy hook penetration. FIG. 3*c*' illustrates an example embodiment where one-way hook elements of field 359' are configured to penetrate down to the base of the loop field 361'. FIG. 3*c*" illustrates another example embodiment where one-way hook elements of field 359" are configured to penetrate through perforations in the base of the loop field 361". As will be appreciated, the one-way hook style minimizes the return ratio of the hook (see FIG. 3*f*) and thus allows for relatively easy hook penetration through the loop field 361' and possibly through the base thereof. In any such cases, the overall thickness of the plate mounting system closure is defined by the fully inserted hook field, and thus any loop variation is neutralized or otherwise mitigated to provide a consistent closure thickness. Example hook shapes that could achieve this goal include, for instance, J-hooks, tapered hooks, one way hooks, and gauging stems, such as high technology hook (HTH) products produced by Velcro USA Inc., such as hook styles 22, 29, and 294. Other comparable but customized shapes will be apparent, such as hooks having a minimized or relatively small prong return (also referred to as return ratio, see FIG. 3*f*) to allow for burrowing through and under loop material so as to allow for hook contact with (or penetration through, as the case may be) the loop base. Tapering of the hook stem side along which the loop will contact during engagement can also be used to cause loop tensioning during rotation, wherein the loop will slide or otherwise 'home' to a snugged position on the hook stem. As previously explained, such snugging may reduce backlash. In still other embodiments, the hooks may be mushroom or palm-tree or nail-head shaped, such as HTH hook styles 31 and 85 from Velcro USA Inc. Such hook designs have a head that can poke through a slit or perforation in the loop base but then operates to inhibit the reverse movement back through that slit/perforation to provide a degree of peel strength. Hook shapes can be customized or otherwise formed, for example, using extrusion, molding, and/or photo etching. In addition, and as will be explained in turn, loop designs that are spaced and structured so the penetration of the hooks is facilitated, can be used to further facilitate a print plate mounting closure providing consistently acceptable print quality. For example spacer fabric, double bar warp knit, loop denier configured to allow for hook penetration, optimization of hook design (e.g., hook geometry such as shape/angle/tapering, and flexibility/resilience) for a given loop design, density and pattern of hooks, density and pattern of loops, dual-height loop, and unnapped loop are all further relevant considerations as will be appreciated in light of this disclosure.

Figure 3D:
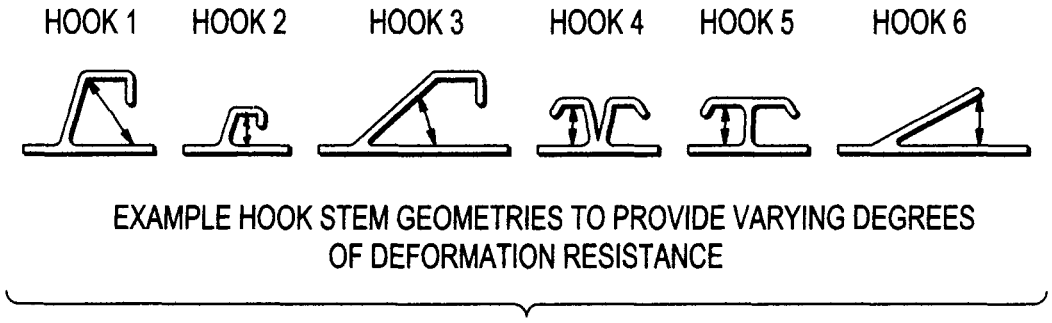
FIG. 3*d* illustrates example hook geometries each of which can be used to provide an integral cushion effect in a print plate mounting system, in accordance with an embodiment of the present disclosure.
Figure 3E:
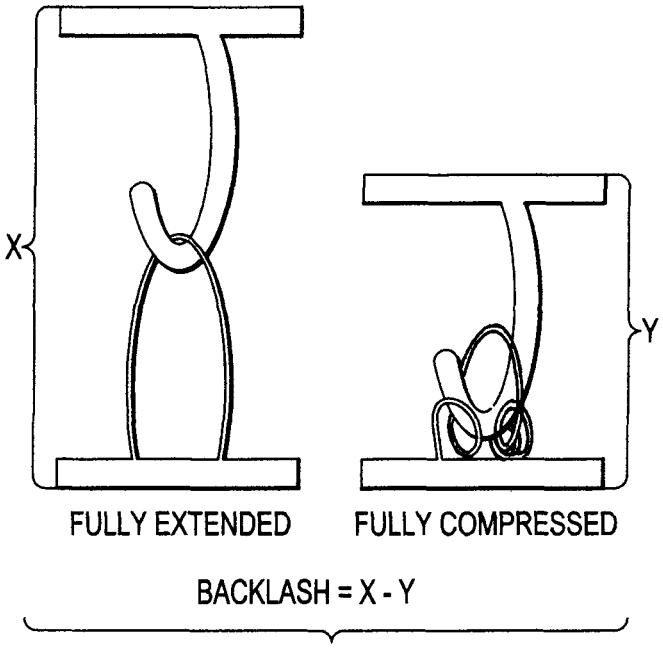
FIG. 3*e* illustrates backlash of an example mechanical bond.
Figure 3F:
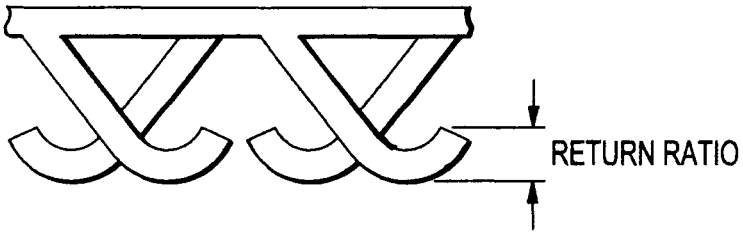
FIG. 3*f* illustrates return ratio of an example hook.

FIG. 3*d* illustrates example hook stem geometries each of which can be used to provide an integral cushion effect in a print plate mounting system, in accordance with an embodiment of the present disclosure. Six different example hook styles are shown, along with a deflection direction (depicted with double-head arrow). As will be appreciated in light of this disclosure, geometry and resilience of hook stems can be varied to provide a varying amount of resistance to deformation during the print process. To this end, it is possible to create a range of softness based on hook stem geometry and resilience. Note that longer arms or branches generally allow for more bending under compressive forces. Hook shapes such as J-shape (Hooks 1, 2 and 3), palm-tree shape (Hook 4), mushroom shape (Hook 5), and one-way or scale-like (Hook 6) can be used to provide a variable amount of rigidity/stiffness during compression, as will be further appreciated in light of this disclosure.

Figure 3G:
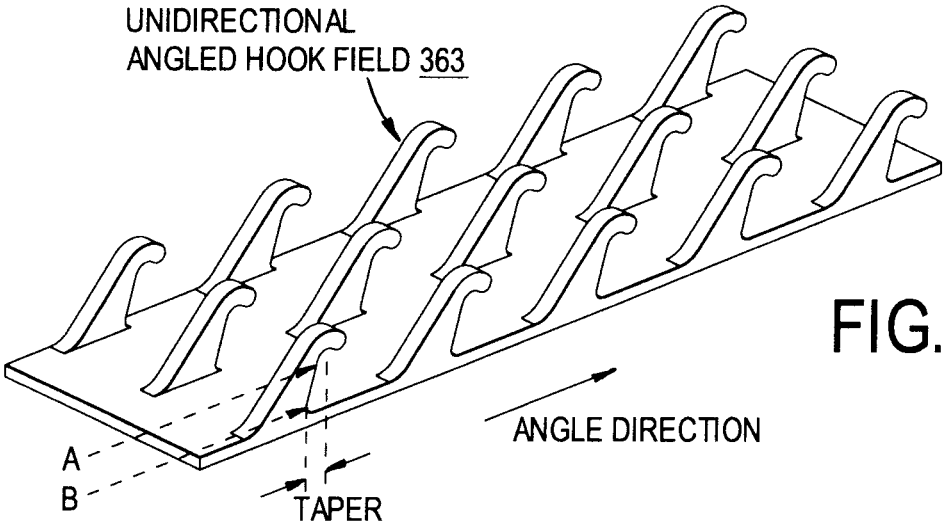
FIG. 3*g* illustrates an example hook-based mechanical bonding surface that can be used in a print plate mounting system configured in accordance with an embodiment of the present disclosure.

FIG. 3*g* illustrates an example hook-based mechanical bonding surface that can be used in a print plate mounting system configured in accordance with an embodiment of the present disclosure. As can be seen, the surface includes a unidirectional angled hook field 363. Note the angle direction. Further note the tapering effect from points A to B on the hook stem. As previously explained, such fields of unidirectional hooks operate in conjunction with the loop material and rotation direction of the print cylinder to provide a snugging effect that inhibits backlash of the mechanical bond. In some such cases, the tapering of the hook stem effectively causes the captured loop to be pulled along the hook stem so as to be closer to the base of the hook field 363 (the loop is pulled from point A to B on the hook stem under the rotation forces) further contributing the snugging effect. In this sense, the engaged loop(s) home to position B during rotation.

As will be further appreciated in light of this disclosure, such a hook field can be used on a print plate, print sleeve, or print cylinder, and the corresponding loop field(s) can be provided on the other element to form the mechanical bond. Table 2 summarizes the relationship between the location of the unidirectional hook field with respect to the hook direction and machine direction.

TABLE 2

Hook Location and Direction v. Machine Direction

| Hook Location | Hook Direction | Machine Direction |
|---|---|---|
| Print Plate | → | ← |
| Print Sleeve | → | → |
| Print Cylinder | → | → |

Note that the hook direction does not have to be precisely aligned with the machine direction, so as to be exactly the same direction. Rather, there may be some degree of offset between the two directions. For instance, in one example case, the hooks may be facing in a direction that is up to 30 degrees different from the machine direction. This might be the case, for instance, when unidirectional hook tape is applied to the print cylinder in a spiral wound fashion, or the hooks are otherwise formed on the cylinder in an offset fashion. In a more general case, the unidirectional hooks can be facing in any direction that is within +/−90 degrees of the actual machine direction. Said differently, the angle formed by a first vector representing the hook direction and a second vector representing the machine direction is not greater than a right angle, in accordance with some embodiments.

Such a hook field 363 can be made using, for example, extrusion or mold techniques to provide a hook tape that can then be applied to the desired print element (e.g., print plate, cylinder, sleeve). In other embodiments, the hook field 363 can be co-extruded or otherwise integrally formed with a photopolymer or other suitable plate material. In other such integrally formed embodiments, the hook field 363 can be used as a substrate upon which a plate is then formed. In still other such integrally formed embodiments, the hook field 363 can be formed in a layer of polyurethane, resin, or other suitable material on a print cylinder core or outer cylinder portion, such that at least part of the print cylinder and the hook field 363 are of a unitary mass of common material. Such a cylinder could be formed, for example, using a molding process that injects the desired material into an appropriate cylinder mold having the desired circumference and hook pattern (and/or other fastener elements) represented therein. In still other embodiments, the hook field 363 can be co-extruded or otherwise integrally formed with a heat-shrinkable material to provide a shrink sleeve. In still other embodiments, the hook field 363 can be co-extruded or otherwise integrally formed with a stretchable material to provide an elastic sleeve.

Figure 3H:
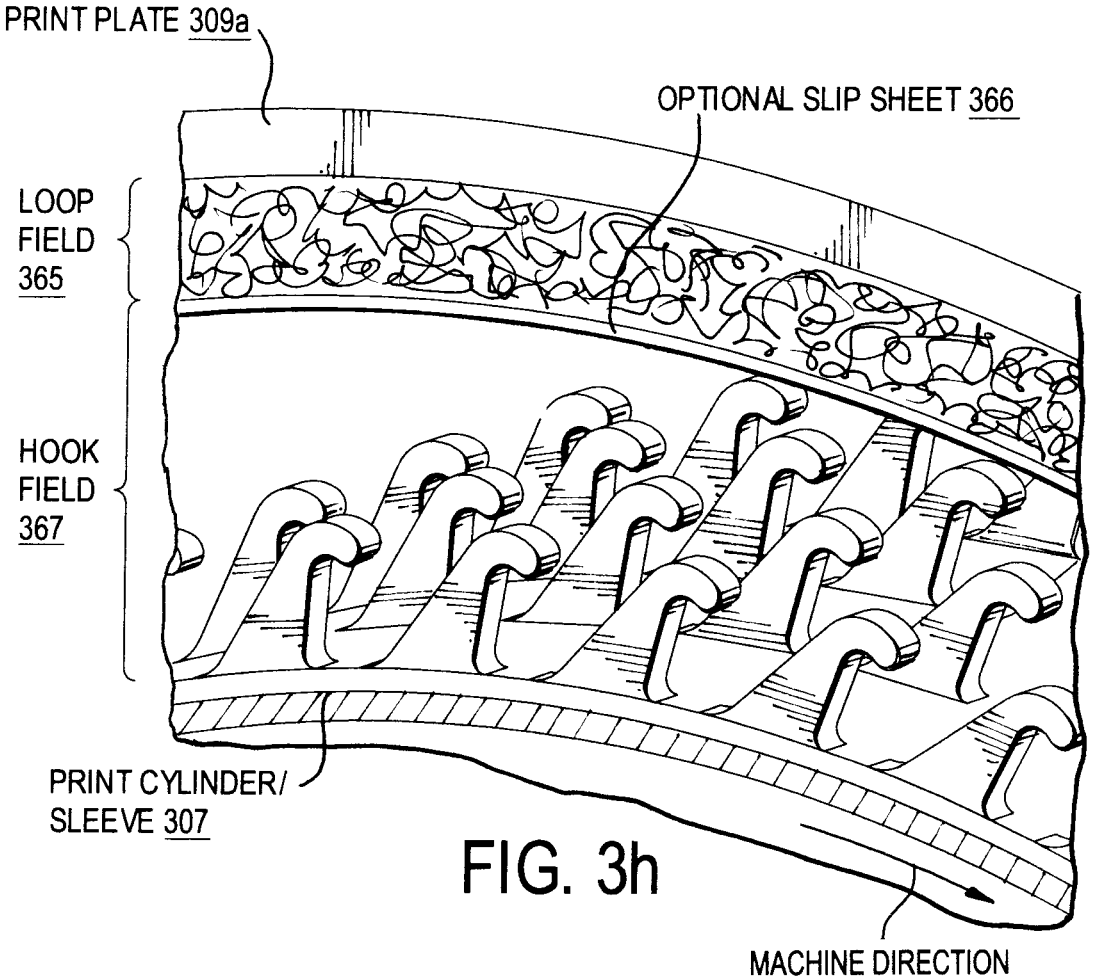
FIGS. 3*h-i* each illustrates a perspective view of a hook-and-loop based print plate mounting system configured in accordance with an embodiment of the present disclosure.

FIG. 3*h* illustrates a perspective view of a hook-and-loop based print plate mounting system configured in accordance with an embodiment of the present disclosure. As can be seen, the system includes a print cylinder/sleeve 307 configured with a unidirectional hook field 367 configured to form a mechanical bond with loop field 365 of plate 309*a*. The mechanical bond has a desired degree of compressibility, particularly when the printing operation is being carried out (e.g., while the print cylinder is turning, 20 to 40 feet/second). As will be appreciated in light of this disclosure, factors that affect this compressibility include, for instance, the hook shape, hook material, hook density, loop construction, loop density, and interplay between the hook and loop. In some embodiments, the hook field 367 is co-extruded or otherwise integrally formed with the print cylinder/sleeve 307 and the loop field is co-extruded or otherwise integrally formed with the print plate 309*a*, so as to reduce the number of interfaces (e.g., there is no need for an adhesive interface between the hook field 367 to the print cylinder/sleeve 307, or between the loop field 365 and the plate 309*a*).

In one example case, hook field 367 is implemented with spiral wound hook tape, wherein the hook tape is configured with a field of unidirectional hooks. Such a combination of unidirectional hooks and spiral winding tends to inhibit edge lifting. In still other such embodiments, the unidirectional hooks are angled downward (rather than standing straight up) so as to provide an acute angle with the surface of cylinder/sleeve 307. In one such case, the unidirectional angled hooks 367 cause a plate snugging effect when the cylinder 307 rotates in the machine direction. In particular, a given loop of field 365 catches on an angled hook of field 367 and is effectively forced toward the vertex of the acute angle (closer to the surface of the cylinder). Not wishing to be limited to any particular theory, it seems that such forces resulting from the machine rotation and unidirectional hook scheme eliminate or otherwise reduce backlash normally attendant a hook-loop bond.

As can be further seen in FIG. 3*h*, an optional slip sheet 366 can be used to facilitate the mounting process. As previously indicated, a slip sheet prevents the engagement of the unidirectional hook field 367 with loop field 365 during the initial plate mounting process. Once the plate 309*a* is in position (as may be indicated by any alignment guides provided with the unidirectional hook field 367 and loop field 365, or by a machine vision indicator), the slip sheet 366 can then be removed. Again, such removal may be done in an incremental fashion (in strips that completely or partially traverse the length of the cylinder/sleeve 307). As will be appreciated, a slip sheet can be used in conjunction with any of the mechanical bonds provided herein, and is not limited to the hook-and-loop bond shown in FIG. 3*h*. Numerous slip sheet configurations will be apparent in light of this disclosure.

Figure 3I:
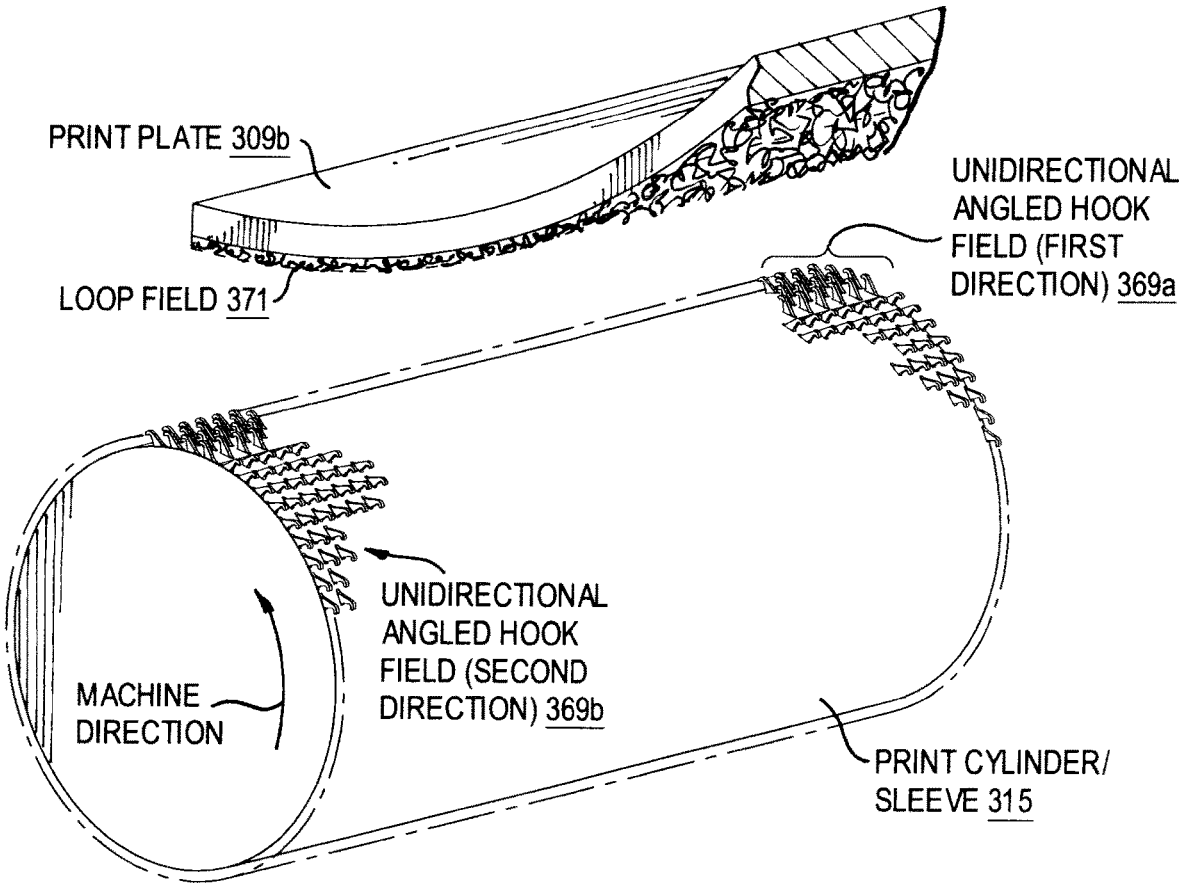
Figure 3I:
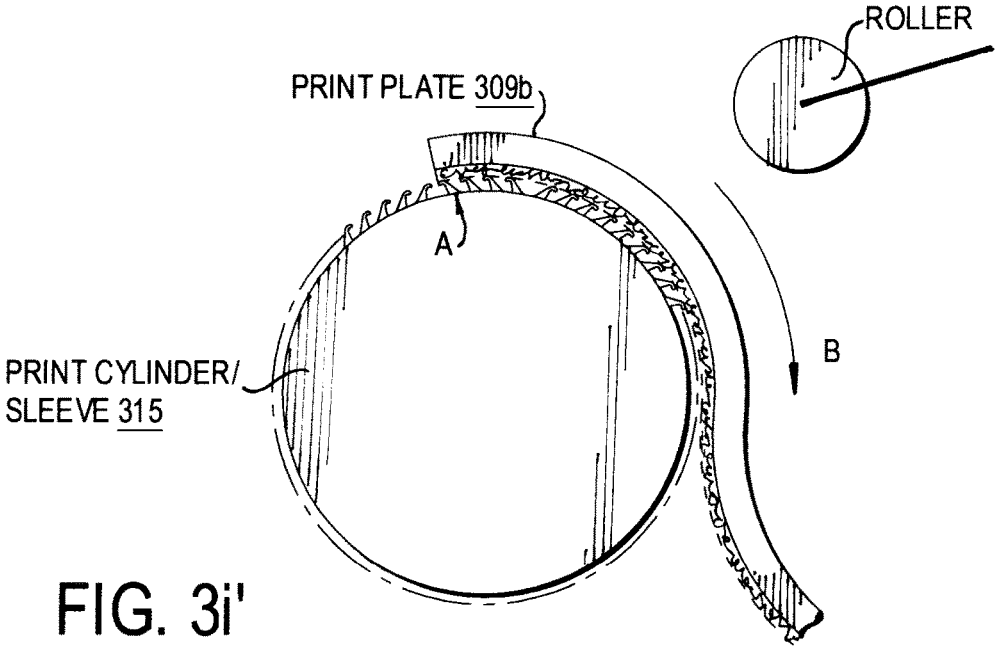

FIG. 3*i* illustrates a perspective view of a hook-and-loop based print plate mounting system configured in accordance with another embodiment of the present disclosure. As can be seen, the system includes a print cylinder/sleeve 315 configured with a first field of unidirectional hooks 369*a* facing in a first direction and a second relatively larger field of remaining hooks 369*b* facing in a second direction that is substantially opposite the first direction. In one such embodiment, the first field 369*a* is a one inch wide field that traverses the length of the cylinder/sleeve 317 that includes 1 to 10 rows of hook elements (e.g., 3 to 5 rows of hook elements), although other configurations will be apparent in light of this disclosure (e.g., clusters of hooks 369*a* evenly spaced one-half inch apart along the length of the cylinder). In operation, the first hook field 369*a* can be used to initially align and secure the plate 309*b* to the cylinder/sleeve 315.

In more detail, and as shown in FIG. 3*i*', the plate 309*b* can be attached to the cylinder/sleeve 315 at point A, which corresponds to field 369*a*. Note the field 369*a* may include any number of alignment features, including the hooks themselves as well as other alignment features such as one or more ridges or channels or pins or press-fittings or other male/female connector arrangements that can guide the alignment process. In any case, the loop of the plate 309*b* engages with field 369*a*. Then, the remaining portion of the plate 309*b* can be rolled onto the remaining portion of the cylinder/sleeve 315, specifically hook field 369*b*. This may be accomplished, for example, using a roller in direction B. The unidirectional hook scheme allows the plate 309*b* to be securely fastened to the cylinder/sleeve 315 in such a manner that backlash of the hook-loop interface is reduced or otherwise managed. As previously indicated, the first and second directions need not be precise and some embodiments may tolerate a degree of deviation from the target directions, as will be appreciated in light of this disclosure.

FIGS. 4*a-l* each illustrates an example loop-based mechanical bonding surface that can be used in a print plate mounting system, in accordance with an embodiment of the present disclosure. As will be appreciated in light of this disclosure, the overall thickness of a hook-and-loop closure making up the mechanical bond should remain relatively consistent to provide adequate print quality. To this end, the thickness of the hook portion of the closure can be controlled very tightly, such as in the case of the HTH products produced by Velcro USA Inc. (e.g., HTH hook styles 22, 29, 31, 85, and 294). So, in accordance with one such molded hook embodiment, the loop loft (thickness) is configured to not affect the overall thickness of the closure. This can be achieved in a number of ways, by either constructing the loop to have a consistent thickness, or by constructing the hooks to alleviate or otherwise neutralize variations in loop thickness, to help control backlash.

Figure 4A:
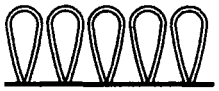
FIGS. 4*a-l* each illustrates an example loop-based mechanical bonding surface that can be used in a print plate mounting system, in accordance with an embodiment of the present disclosure.
Figure 4B:
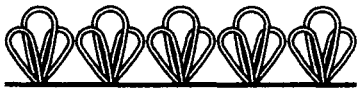

Textile fabrics are generally made using a weaving, circular knitting, warp knitting, flat-bed knitting, and non-woven processes, and any of these processes can be used to create a hook engageable fabric in accordance with an embodiment of the present disclosure. Many textile fabrics do not contain a pile surface and are used for general textile use. Other textile fabrics which are often manufactured for fleece fabrics are manufactured with a pile surface and the pile surface is napped and broken. This napping process can create an irregular pile height. In many cases this fabric is then sheared to create a uniform pile height such as used in velour and Polartec® fabrics but because the loop pile has been broken or sheared, these fabrics are not hook engageable. To this end, unbroken loop fabrics are required if they are to be used as hook fasteners. These fabrics are often napped fabrics, and subject to pile height irregularity mentioned above. While napped or irregular pile height fabrics may work in some cases, there are a number of ways to make the thickness of fabric relatively consistent for purposes of backlash management, in accordance with an embodiment of the present disclosure. For example, a warp knit fabric made on a 3-bar knitter where a $3^{rd}$ dimensional loop pile is formed on the knit machine will generally have a consistent thickness if a napping or brushing step is not performed. Additionally, a 2-bar warp knit machine with a pile device, where a 3-dimensional pile is formed on the machine, can also make an unnapped warp knit fabric having a consistent thickness. In more detail, with many 2-bar fabrics commonly made, the third dimension pile is formed by napping or brushing to raise the pile. The napping process disorients the pile surface, and often can create a loop pile height with varying thickness. FIG. 4*b* illustrates a multifilament loop yarn after napping (note the numerous different loop heights). However, when loop pile is formed on a 3-bar fabric, or a 2-bar knitting machine without napping, a pile height can be created with little variation. With this method, the loop height can be changed by changing yarn tensions or sinker height. So, a loop fabric having a particular desired thickness can be provided.

Figure 4C:
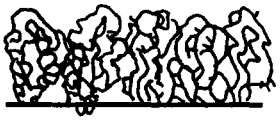

In another example embodiment, a warp or circular knit fabric using multifilament texturized yarns can be used to implement the loop field of the mounting system. For instance, in some example cases, yarns can be used to create a pile by using flat yarns that can be monofilament or multifilament. Multifilament yarns can be flat yarns with round or other cross-sections, where the fibers in the yarn are straight. FIG. 4*a* illustrates one such example embodiment, wherein the loop includes a multifilament loop pile with flat yarn. In other example cases, texturized or crimped yarns are used to create a bulkier loop pile with separation of the filaments in the yarn bundle without napping. This bulkiness in the pile can create a more resilient surface with spring-like properties. As previously explained, this resiliency or cushion-effect can be used to reduce or otherwise manage backlash and may further eliminate the need for an external foam pad in the mounting system. FIG. 4*c* illustrates one such example embodiment, wherein the loop includes a multifilament loop pile with texturized yarn. Note the difference between texturization (4*c*, filaments fan-out but maintain consistent height) and napping (4*b*, filaments are effectively pulled to inconsistent heights).

Figure 4D:
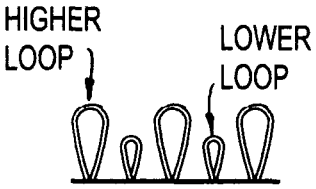
Figure 4E:
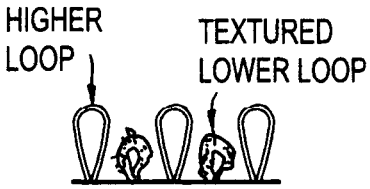
Figure 4F:
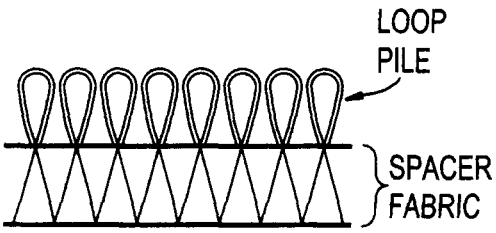
Figure 4G:
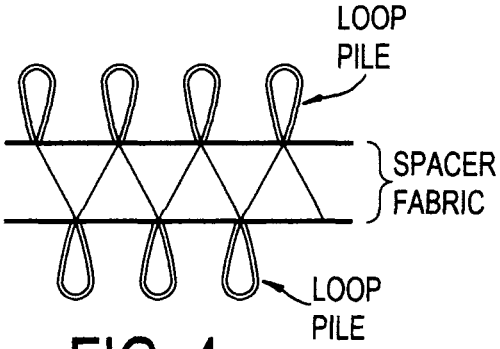

In another example embodiment, so-called spacer fabrics can be made by weaving, or by using circular or warp or flatbed knitting machines. As is generally known, these types of conventional fabrics include top and bottom fabric layers, with a mono or multifilament yarn connecting the top and bottom layers. In accordance with an embodiment herein, a spacer fabric integral to the loop layer can be used to provide a cushioning effect beneficial to the print process. In one such embodiment, with additional knitting bars added, the spacer fabric knitting machine can also knit a loop pile on one or both of the top and bottom spacer fabric surfaces. This type of modified spacer fabric may be preferred in plate mounting applications tolerant of thicker closures. FIG. 4*f* illustrates an example spacer fabric configured with a loop pile on one surface, and FIG. 4*g* illustrates another example spacer fabric configured with a loop pile on both the top and bottom fabric surfaces, in accordance with embodiments of the present disclosure. Note, however, in other embodiments one or both layers of a spacer fabric can be constructed with texturized yarns or the like to provide loop-like engageability without developing a loop pile. Such a configuration may be beneficial in cases where a thinner closure is desired (avoidance of loop pile).

Figure 4H:
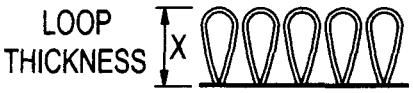
Figure 4I:
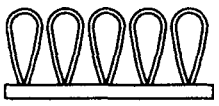
Figure 4J:
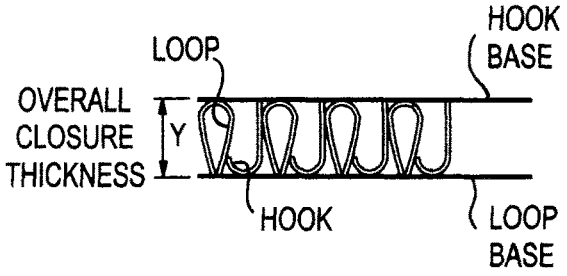
Figure 4K:
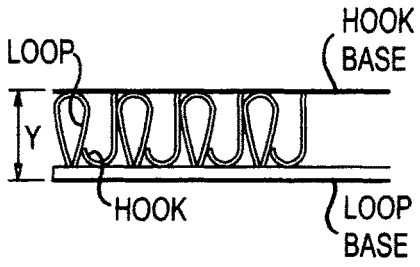

In another embodiment, yarn size (denier) and yarn thickness changes can be made to change fabric thickness of warp or circular, or flatbed knit fabrics. For instance, in plate mounting applications where a thin closure is preferred, the overall textile loop thickness can be changed by changing yarn denier, and by also utilizing flat or textured yarns. When these yarns are placed in the fabric ground or backing (loop base), the backing thickness changes. In one example plate mounting closure system configured in accordance with an embodiment of this disclosure, the loop pile may allow entry by its mating hook, so that the overall thickness of the closure is mostly determined by the thickness of the ground or back of the textile, and the thickness of the hook. The thickness of the back of the loop textile can be changed by changing the yarn denier. In some cases, fine yarns with a low thickness as low as 10 denier, can be used to make a very thin backing. Thicker yarns such as 20, 40, 70, 100, 140 denier yarns can be used in light to medium weight circular or warp knit fabrics. Heavier yarns around 250 denier are used in heavier weight knit, but yarns exceeding 1000 denier are available. FIG. 4*h* illustrates an example loop pile having thickness X and is configured with low denier ground to reduce overall closure thickness, in accordance with an embodiment. A corresponding example closure is shown in FIG. 4*j*, which includes a field of J-hooks engaging with the low denier ground yarn. Note the overall thickness of the closure (Y) is effectively defined by the hook geometry. In some such cases, recall that an integral cushion effect can be provided by flexible hook stems. In other cases, rigid hooks in conjunction with trapped loop or an internal foam layer may provide an integral cushion effect. FIG. 4*i* illustrates another example loop pile having the same thickness X but is configured with high denier ground yarn to increase overall closure thickness and provide a degree of integral cushion effect, in accordance with another embodiment. A corresponding example closure is shown in FIG. 4*k*, which also includes a field of J-hooks engaging with the high denier ground yarn in knit.

Figure 4L:
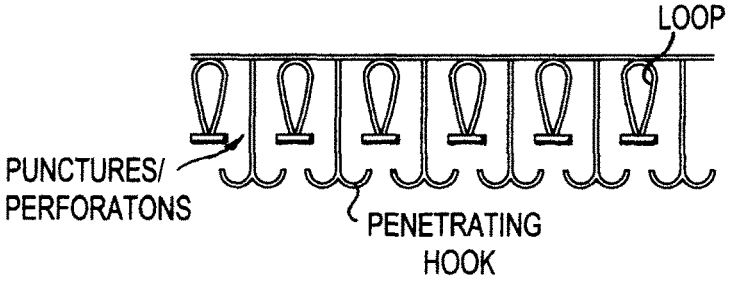

In another embodiment, selectively punctured or perforated loop fabric can be used. In more detail, one example case of a hook-and-loop plate mounting closure system can be configured so that a least some hooks penetrate past the loop component (if present) and through the ground (loop base), and anchor into the backside of the loop fabric when compression applied during the mounting process is released. In one specific such case, a dual-height hook arrangement is provided, wherein the loop fabric is designed to intentionally create waffle like openings into the loop fabric backing thereby allowing taller hooks to penetrate through these openings, while shorter hooks engage with the loops. In one such case, the taller hooks can be configured to better pass through the loop base material (e.g., J-hook, arrow-head hook, one-way hook), while the shorter hooks can be configured abut up against the loop base (e.g., palm-tree or mushroom or nail-head hook). In some cases, a plain fabric could be punctured to create openings for hooks to enter. In some such cases, a bed of spaced needles used to puncture the fabric can be heated, to melt and seal the puncture edges to prevent fraying. Using this type of compressed plate mounting closure system can be used to reduce the overall thickness of the closure system. FIG. 4*l* illustrates one such example embodiment. Note the palm-tree like hook heads penetrate through the perforations/punctures during initial mounting compression, and upon release of that compression, the hook heads catch on the underside of the loop backing/base. The loops thus remain in a compressed state, in some such cases, until an appropriate and intentional plate removal (dismount) force is provided.

In another embodiment, a two-level loop fabric can be used. In more detail, a warp or circular knit fabric is configured with two distinct height levels of the loop pile. The upper loop pile can act as a spring or integral cushion, so when the closure is compressed, the hook would engage with the lower level loop. As with other integral cushioning techniques provided herein, backlash can be reduced or otherwise managed to create a tighter and more consistent plate mounting system closure. In some cases, the higher loop could be made using flat yarns of high-tenacity which would be stiffer, and provide a spring-like rebound after engaging. In other cases, high-bulk texturized yarn could be used as the upper layer, which would accomplish a similar function. Switching the location of flat and texturized yarns in the two-level fabric construction may provide improved performance, for some printing applications. FIG. 4*d* illustrates one example embodiment having a two-level loop pile configured with flat yarns, and FIG. 4*e* illustrates another example embodiment having a two-level loop pile configured with tall flat yarn loops in the upper level and shorter texturized yarn loops in the lower level.

In some cases any of the yarns mentioned with respect to FIGS. 4*a-l* can be texturized, which increases the yarn thickness relative to flat yarns, and can also make the fabric backing have some spring or cushion effect integral with the closure, as previously explained. In some specific example cases, Lycra® yarns or other stretch yarns can be added to the loop fabric backing to provide an integral cushion effect. These yarns are normally added to textile fabrics to provide stretch and recovery, but because they are synthetic or natural rubber, will also provide some cushioning and rebound from compression. In other cases, Lycra® yarns which are wrapped in a textile yarn can be used in the loop fabric backing to provide an integral cushion effect. These yarns are also used to make stretch fabrics, and would also provide some resiliency.

In another embodiment, stretch latex coatings can be used in the plate mounting closure system. For instance, on some stretch fabrics, a latex or rubberized coating can be applied to the loop fabric backing to provide additional reinforcement to stretch fabrics. These coatings can also be used to provide some cushioning and rebound from compression (integral cushion effect).

As will be further appreciated in light of this disclosure, the thickness (height) of the loop can be optimized to work with particular hook geometry to provide a relatively thin closure. So, in accordance with one embodiment, a dense hook field having a relatively low-profile (e.g., 1700 hooks per square inch, with each hook 0.02 inches in height) can be used in conjunction with an unnapped loop having a similar density and low-profile to provide a high degree of hook-loop engagement. Alternatively, a less dense hook field having at least some of the hooks having a higher profile (e.g., 900 hooks per square inch, with each hook 0.028 inches in height) can be used in conjunction with an unnapped loop having a similar profile but lower density to provide a degree of hook penetration through the loop base and also optionally a degree of hook-loop engagement to provide a robust closure. In one such embodiment, note that the hook field may have multiple hook heights (e.g., dual hook-height, where shorter hooks engage loop and taller hooks penetrate through loop base). In any such cases, the density of the loop can be adjusted to allow the hooks higher probability to reach the loop base material or penetrate through perforations or holes therein.

Example Hook-and-Hook and Channel-Based Mechanical Bonds

Figure 5A:
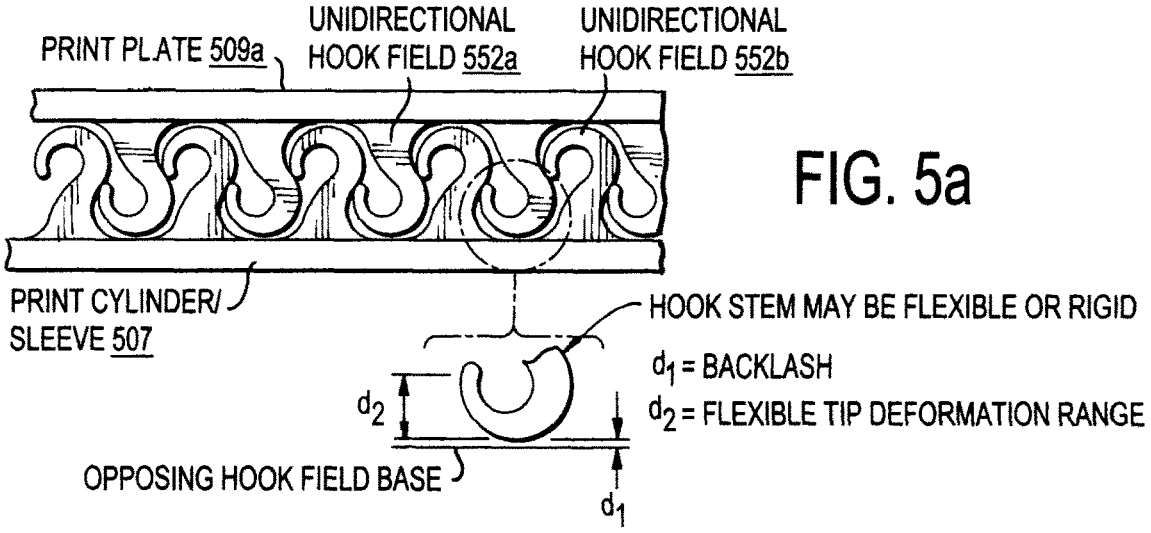
FIGS. 5*a-b* each illustrates a cross-sectional view of a hook-and-hook based print plate mounting system configured in accordance with an embodiment of the present disclosure.
Figure 5B:
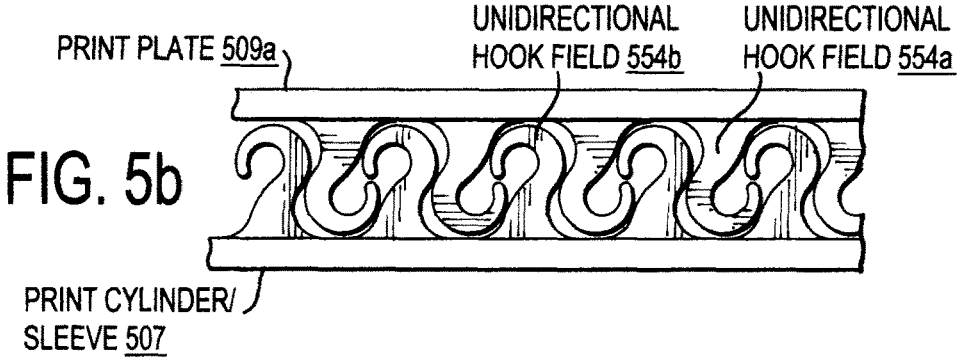

FIG. 5*a* illustrates a cross-sectional view of a hook-and-hook based print plate mounting system configured in accordance with an embodiment of the present disclosure. As can be seen, the plate mount system closure in this example case includes a print plate 509*a* having a unidirectional hook field 552*a*, and a print cylinder/sleeve 507 having a unidirectional hook field 552*b*. FIG. 5*b* shows a similar arrangement except for opposite facing plate hooks, where the example plate mount system closure includes a print plate 509*b* having a unidirectional hook field 554*a*, and a print cylinder/sleeve 507 having a unidirectional hook field 554*b*. As previously explained, the respective hook fields can be integrally formed with the corresponding print elements (plate, cylinder, or sleeve), or can be subsequently attached to those print elements.

As can be further seen, there may be a degree of orthogonal play associated with the hook-and-hook mechanical bond. In particular, $d_1$ represents the potential backlash distance of the hook-hook connections making up the bond, in some configurations. Other such embodiments may be configured to provide a $d_1$ of zero. In general, backlash in a hook-and-hook design can be relatively small, depending on the mating qualities of the corresponding hook fields. In addition, note that the hook stems can be made flexible, so that they resistively deform if the hook is compressed into the hook field base, as further shown in FIG. 5*a*. $D_2$ represents this deformation distance, which can vary from one hook design to the next. Note, however, that other embodiments may include a rigid or otherwise less flexible hook design, where $d_2$ is substantially zero.

In one specific example embodiment, the respective hook fields (552*a-b* and 554*a-b*) are implemented with a hook-and-hook configuration similar to that used in Press-Lok® brand products produced by Velcro USA Inc. U.S. Pat. Nos. 6,687,962, 8,225,467, 8,448,305, and 8,685,194, as well as U.S. Patent Publication Nos. 2013/0239371, 2013/0280474, and 2013/0318752 all disclose further details of example hook element configurations that can be used as well as forming methods. Each of these applications is herein incorporated by reference in its entirety. The hooks may have any number of configurations, as will be appreciated in light of this disclosure (e.g., any number of HTH hook styles from Velcro USA Inc. may be used, for instance).

As will be further appreciated in light of this disclosure, note that unidirectional hooks are not required for a hook-and-hook based closure. For instance, some Press-Lok® brand hook-and-hook products alternate the direction of hooks (e.g., from row to row) and such that the hooks engage in both or otherwise multiple directions. Such an alternating or multi-direction pattern can be used in a plate mounting system as provided herein. See, for instance, FIGS. 18*a-c* which depict an example hook field having hooks in an alternating pattern so as to provide a first group of hooks facing in a first direction (e.g., or within 15 degrees of that direction) and a second group of hooks facing in the opposite direction (e.g., or within 15 degrees of that direction). Other suitable hook-and-hook configurations will be apparent in light of this disclosure.

Figure 5C:
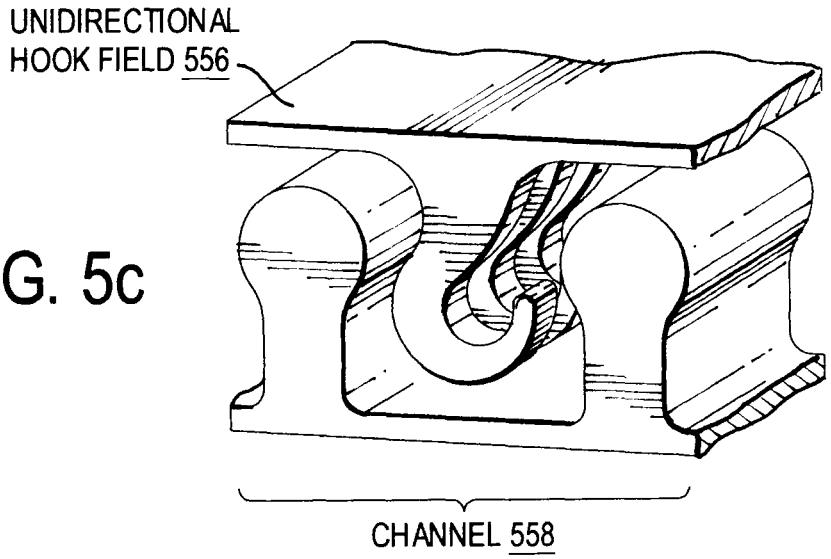
FIG. 5*c* illustrates a cross-sectional view of a hook-to-channel based print plate mounting system configured in accordance with an embodiment of the present disclosure.

FIG. 5*c* illustrates a cross-sectional view of a hook-to-channel based print plate mounting system configured in accordance with an embodiment of the present disclosure. As can be seen, the plate mount system closure in this example case includes a unidirectional hook field 556 configured to interlockingly engage with a corresponding field of channels 558. A single row of hooks 556 and the corresponding channel 558 is shown in cut-away fashion in effort to illustrate the row of hooks 556 interlockingly engaging that channel 558 (not drawn to scale). Note that other embodiments may have channels configured with straight walls (rather than the bulbous head shape), but such a configuration may provide only shear resistance and not interlocking resistance per se, which may translate into lower peel strength. Each of the hook field 556 and channel 558 can be implemented on either of the print plate, print sleeve, or print cylinder. Just as with the examples in FIGS. 5*a-b*, the hook fields 556 and channels 558 can be integrally formed with the corresponding print elements (plate, cylinder, or sleeve), or can be subsequently attached to those print elements (e.g., hook/channel tape or other suitable add-on component).

Figure 5D:
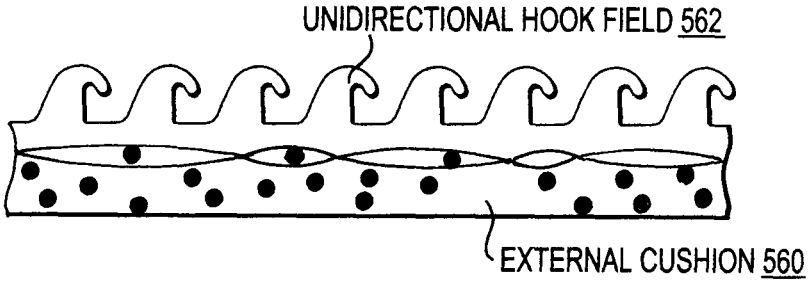
FIG. 5*d* illustrates a cross-sectional view of a hook-based mechanical bonding surface that can be used to provide a desired degree of external cushion effect in a print plate mounting system, in accordance with an embodiment of the present disclosure.

Note how each of the embodiments in FIGS. 5*a-c* provide an alignment feature with respect to mounting the plate on the print cylinder/sleeve. Further note that such mechanical fastener features can be configured to provide a relatively low degree of compressibility and backlash, as well as a relatively low overall closure thickness. As will be appreciated in light of this disclosure, such mechanical fasteners can be used in conjunction with cushioning (either integral to the mechanical bond, or external thereto) to facilitate a desired print quality, depending on particulars of the print job. FIG. 5*d* illustrates an example unidirectional hook field 562 configured with an external cushion 560. Embodiments with integral cushioning will be discussed in turn.

In any such cases, the density of the hook field can be configured to provide a uniform distribution of pressure between the print plate and cylinder. In general, and without wishing to be held to any particular theory, it seems that a higher distribution of hooks translates to lower backlash and a thinner overall closure. Conversely, a lower distribution of hooks translates to higher backlash and a thicker overall closure. In more detail, hook fields that are densely populated tend to be relatively short and more rigid than hook fields that are less densely populated. Hook field densities may range, for example, from about 500 hooks per square inch to about 2000 hook per square inch, in accordance with some embodiments of the present disclosure. Example hook designs include HTH hook styles 22 and 29 from Velcro USA Inc, which have hook densities of about 900 and 1700 hooks per square inch, respectively. The 22-style hook is 0.028 inches in height and the 29-style hook is 0.02 inches in height. Customizations of these example hook designs to, for instance, reduce the hook return ratio (via mold change) and/or modify resiliency (via resin change) will be apparent in light of this disclosure.

Example Gear-Based Mechanical Bonds

Figure 6A:
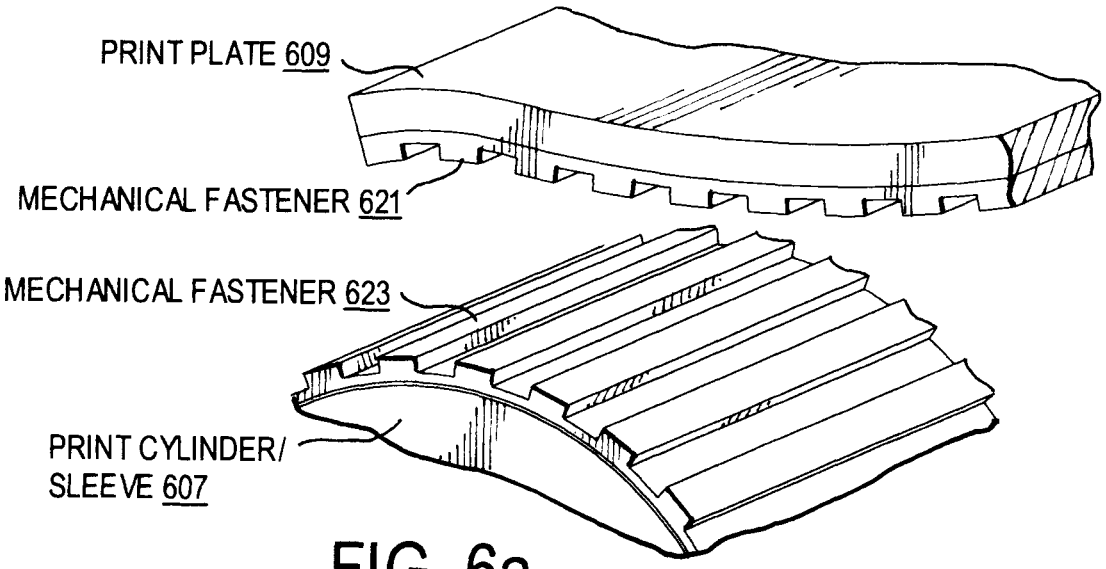

FIGS. 6*a-b* collectively illustrate perspective and cross-sectional views of a gear-based print plate mounting system configured in accordance with an embodiment of the present disclosure. As can be seen, the plate mount system closure in this example case includes a print plate 609 having a gear-based mechanical fastener 621, and a print cylinder/sleeve 607 having a corresponding gear-based mechanical fastener 623. As will be appreciated, the respective gear fields 621 and 623 are configured to snuggly engage one another in a locking fashion when exposed to rotational forces of a print cylinder. As will be further appreciated, the respective gear fields 621 and 623 can be integrally formed with the corresponding print elements (plate, cylinder, or sleeve), or can be subsequently attached to those print elements. A number of permutations will be apparent.

In one embodiment, the gear-based mechanical fastener 621 is implemented as a gear tape that is applied to the non-print side of the print plate 609 using adhesive or some other suitable bonding mechanism (e.g., ultrasonic weld). Alternatively, the gear-based mechanical fastener field 621 can be used as a substrate upon which the print plate 609 is formed. The gear-based mechanical fastener 623 can be, for example, integrally formed on a print sleeve/cylinder 607, via an extrusion or molding process. Alternatively, the gear-based mechanical fastener 623 is implemented as a gear tape that is applied to the print cylinder/sleeve 607. The gear tape can be formed using, for example, molding or extrusion process, or processes similar to those used in making hooks as provided herein.

In any such cases, such a gear-based mechanical bond generally provides a lower durometer and can be further used in conjunction with foam layers to provide a degree of cushioning if so desired. Note that while the gear troughs and ridges transverse the cylinder in the depicted embodiment, other embodiments may include smaller/shorter such gear troughs and ridges configured in a sequential or array-like fashion. Further note the self-aligning quality associated with such gear-based plate mounting systems.

Example Elastic Mounting System

FIG. 7 illustrates a cross-sectional view of an elastic hook-and-hook based print plate mounting system configured in accordance with an embodiment of the present disclosure. As can be seen, this example configuration includes hook tape 710, which is used as a substrate upon which the print plate 709 is formed. In addition, hook tape 712 is bonded to the print cylinder/sleeve 707 with adhesive. Each of the hook tapes 710 and 712 include respective mechanical fasteners 725*a* and 725*b*, each configured with one way hooks, or scales. In alternative cases, the print plate 709 can be used as a substrate upon which the hook tape 710 is formed, such as the case where the hook tape 710 is added to the back of the print plate 709 via injection molding, continuous molding, or 3-D printing. Alternatively, the hook tape 710 could be formed over melt blown urethane, elastic knit, or stand-alone. In any such cases, the hook tape 710 can be comprised of elastomeric polymer thereby enabling stretch and snap-back during plate mounting, in accordance with some embodiments.

Note that such stretch qualities in the hook tape 710 may be transferred to the plate 709, which may in turn cause some distortion in the printed image. However, the degree of distortion may or may not be a problem. For instance, if the hook strain is small or slight, then the elastic nature of the hooks would result in a contraction after the applied force is removed (snap back, much like a rubber band). In other words, the elastic hook tape 710 material would attempt to rebound. This would minimize the strain and stretch and as a result, the impact on the plate 709 would be relatively small. Depending on the accuracy requirement and strain (stretch), this may be acceptable. Also, this elasticity would allow the hooks 725*a* to engage with the hook field 725*b* (or loop field, as the case may be) and improve the adhesion (peel) strength. Further note that in some places, the elastic hook tape 710 would rebound to its original aspect ratio and this would result in no or otherwise minimal printed image deformation.

Interlocking hook tape 712 provides a complimentary field of hooks 725*b* to engage with the hooks 725*a* of hook tape 710, and can be pre-mounted to the print cylinder for longer term use. As will be appreciated, such reusable qualities enable continuous repositioning and quick change-over processes by printer operator. In this specific example case, the opposing, interlocking nature of hook fields 725*a* and 725*b* (one way hooks, formed with processes similar to those used to form other molded hooks, as previously explained) prevents slippage during the rotational print process. Further note that such interlocking hook-and-hook or hook-to-channel designs may enable the print plate 709 to slide on and off the print cylinder for easier assembly, and may also provide a self-alignment quality (to reduce time spent on registration of print plate to print machine).

Angled Hooks with Pressure Based Adhesive

FIG. 8 illustrates a cross-sectional view of a hook-to-adhesive based print plate mounting system configured in accordance with an embodiment of the present disclosure. As can be seen in this example case, the mounting system includes hook tape 816 integrally formed with the print plate 809. The hook tape 816 includes mechanical fastener 827, which is configured with a number of unidirectionally angled hooks. In addition, a coating of pressure sensitive adhesive 818 is provided over the surface of the print cylinder/sleeve 807. As can be further seen, the hook stems optionally have a roughened top surface to create improved adhesion to the pressure sensitive adhesive 818. In this instance, the print plate 809 having the integrated hooks 827 would interface with the pressure sensitive adhesive 818. Note in some embodiments that the pressure sensitive adhesive 818 could be selectively applied to the tips of the hooks 827 rather than as a blanket coating on the print cylinder/sleeve 807. Further note that the hooks stems may be rigid (to provide relatively hard or low cushion effect) or flexible (to provide relatively softer or higher cushion effect).

Vacuum, Suction, and Magnetic Based Mounting Systems

Figure 9A:
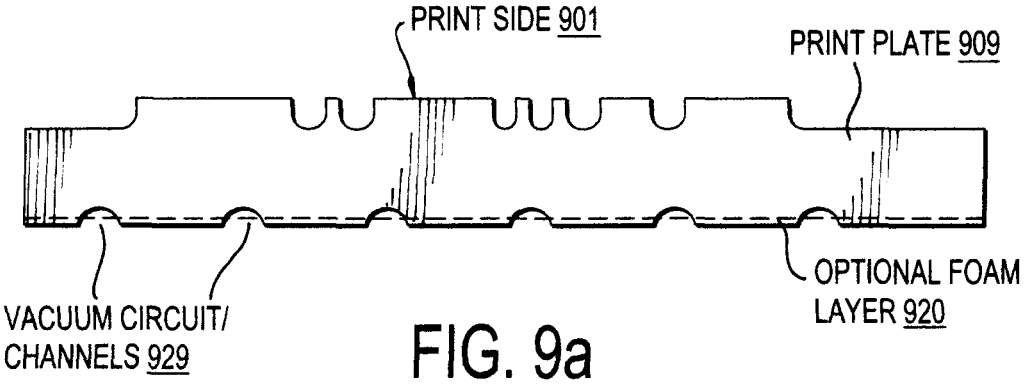
FIGS. 9*a-b* collectively illustrate cross-sectional and perspective views of a vacuum-based print plate mounting system configured in accordance with an embodiment of the present disclosure.
Figure 9B:
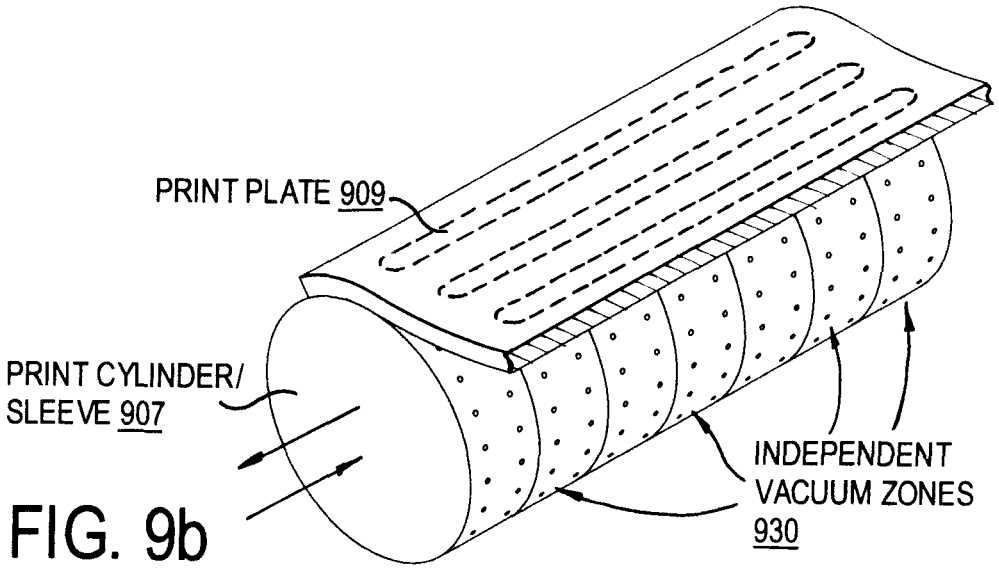

FIGS. 9*a-b* collectively illustrate cross-sectional and perspective views of a vacuum-based print plate mounting system configured in accordance with an embodiment of the present disclosure. As can be seen, the system includes a print plate 909 having a print side 901 and a number of vacuum circuits or channels 929 on the opposing side. An optional foam or cushion layer 920 may be embedded or attached to the vacuum side of the plate 909, to provide a degree of cushion effect. As can be further seen with reference to FIG. 9*b*, the print cylinder/sleeve 907 includes a number of independent vacuum zones 930 that can operate in conjunction with the vacuum circuits or channels 929 of the plate 909. Note that the vacuum can pull through the optional foam layer 920, in accordance with some embodiments. In some such cases, a sealing perimeter around the foam layer 920 may be provided so that the vacuum can form. The sealing perimeter can be implemented with, for example, a rubber gasket or other suitable material that will provide a suitable vacuum seal. As previously explained, the vacuum can be used selectively (e.g., at edges of print plate) and/or in conjunction with other mechanical fasteners provided herein.

Figure 10:
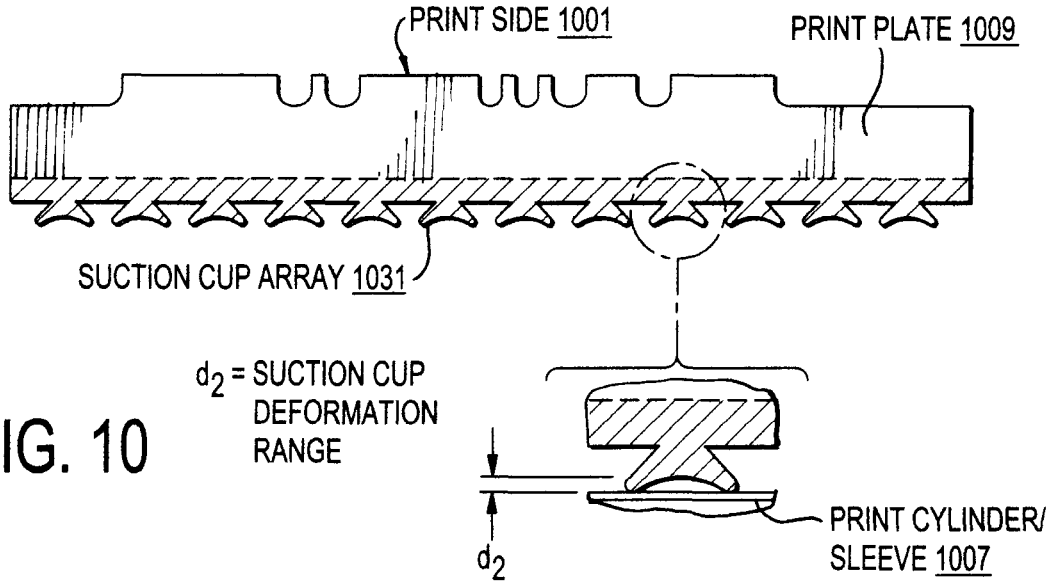
FIG. 10 illustrates a cross-sectional view of a suction-based print plate mounting system configured in accordance with an embodiment of the present disclosure.

FIG. 10 illustrates a cross-sectional view of a suction-based print plate mounting system configured in accordance with an embodiment of the present disclosure. As can be seen, the system includes a print plate 1009 having a print side 1001 and a suction cup array 1031 on the opposing side. As can be further seen, note that the suction cups may be configured to provide a range of deformation $d_2$, so as to provide a degree of cushion effect when bonding to the print cylinder/sleeve 1007. As previously explained, the suction cup array can be used selectively (e.g., at edges of print plate) and/or in conjunction with other mechanical fasteners provided herein. Just as discussed with respect to hooks, the suction cup array 1031 may be integrally formed with the corresponding print elements (plate, cylinder, or sleeve), or can be subsequently attached to those print elements (e.g., suction cup tape). Note that the geometry of the suction cups can be comparable to various hook provided herein, so as to effectively provide a field of micro-cups. A number of permutations will be apparent.

FIGS. 11*a-b* collectively illustrate cross-sectional and perspective views of a magnet-based print plate mounting system configured in accordance with an embodiment of the present disclosure. As can be seen, the system includes a print plate 1109 having a print side 1101 and a magnetic layer 1133 on the opposing side. The magnetic layer 1133 can be, for instance, magnetic itself, metal, or a magnet-receptive coating. An optional foam or cushion layer 1132 may be embedded or attached to the magnetic side of the plate 1109, to provide a degree of cushion effect. As can be further seen with reference to FIG. 11*b*, the print cylinder/sleeve 1107 includes a magnetic surface that can operate in conjunction with the magnetic layer 1133 of the plate 1109. Note that the magnetic force can operate through the optional foam layer 1132, in accordance with some embodiments. In some embodiments, the magnetic layer 1133 can effectively be embedded within the optional foam layer 1132. For instance, metal pieces such as iron flakes (or other suitable metal flakes) can be embedded within foam layer 1132, wherein the metal flakes operate in conjunction with a magnetic cylinder/sleeve 1107. As previously explained, the magnet can be used selectively (e.g., at edges of print plate or central portion of plate) and/or in conjunction with other mechanical fasteners provided herein. In some embodiments, for instance, note that iron flakes (or any other suitable metal pieces) can be embedded in the print plate (e.g., within magnetic layer 1133 and/or optional foam layer 1132) or a print plate attachment, such that the electromagnetic force is higher on outside edges of the plate. In one example such case, the concentration of metal flake at the edges is greater than the concentration of metal flake elsewhere on the plate, so as to provide the higher electromagnetic force.

Plate Mounting Systems with Edge Lifting Inhibitor

FIGS. 12*a-b* collectively illustrate cross-sectional and perspective views of a print plate mounting system configured to inhibit edge peeling of plate, in accordance with an embodiment of the present disclosure. As can be seen, the system includes a print plate 1209 having a print side 1201 and magnetic and/or vacuum channel edges 1234 on the opposing side. An optional fastener layer 1236 may be provisioned between the plate edges to secure the plate to the print cylinder/sleeve 1207. The fastener layer 1236 can be, for example, any of the mechanical bonds provided herein, or a traditional double-sided plate mounting tape configured with or without a foam layer. As can be further seen with reference to FIG. 12*b*, the print cylinder/sleeve 1207 includes a corresponding magnetic surface and/or vacuum zone 1235 that can operate in conjunction with the magnetic and/or vacuum channel edges 1234 of the plate 1209. In one specific example such configuration, the edges 1234 are implemented with embedded metal flake at a relatively high concentration (e.g., 25 to 75 percent by volume, or 50 to 75 percent by volume, or other suitable concentration that provides a desired magnetic bond), and the corresponding surface 1235 can be implemented with a magnetic surface that electromagnetically engages with the metal flake 1234. As previously explained, a higher concentration of metal flake can be provisioned as the edges of the plate, relative to other plate areas having some concentration of metal flake embedded therein (or no metal flake embedded therein). As you herein, a given concentration by volume can be assessed by an average volume taken across a plurality of cross-sections in a given target area. It will be further appreciated that the transition between high concentration areas and lower concentration areas may be abrupt or graded.

Figure 13:
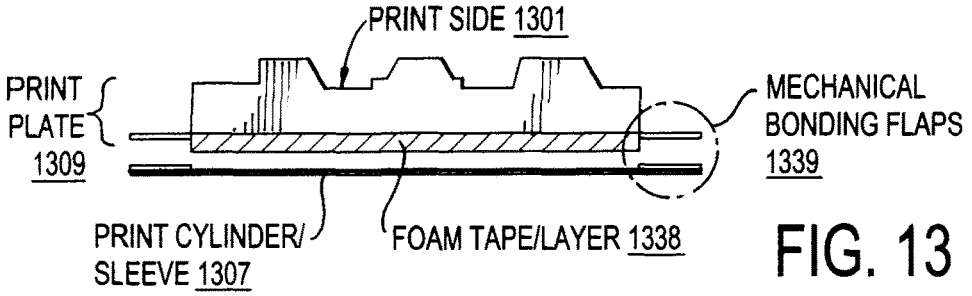
FIG. 13 illustrates a cross-sectional view of a print plate mounting system configured to inhibit edge peeling of a mounted print plate, in accordance with another embodiment of the present disclosure.

FIG. 13 illustrates a cross-sectional view of a print plate mounting system configured to inhibit edge peeling of plate, in accordance with another embodiment of the present disclosure. As can be seen, the system includes a print plate 1309 having a print side 1301 and a foam tape layer 1338 on the opposing side. The plate can be bonded to the print cylinder/sleeve 1307 using the foam double-sided tape layer 1338 as normally done. However, in addition, each of the plate 1309 and cylinder/sleeve 1307 are further configured with complementary mechanical bonding flaps 1339. The bonding flaps 1339 can be implemented with any of the mechanical bonding techniques provided herein, so as to inhibit edge lifting of the plate 1309 and as will be appreciated in light of this disclosure.

Figure 14A:
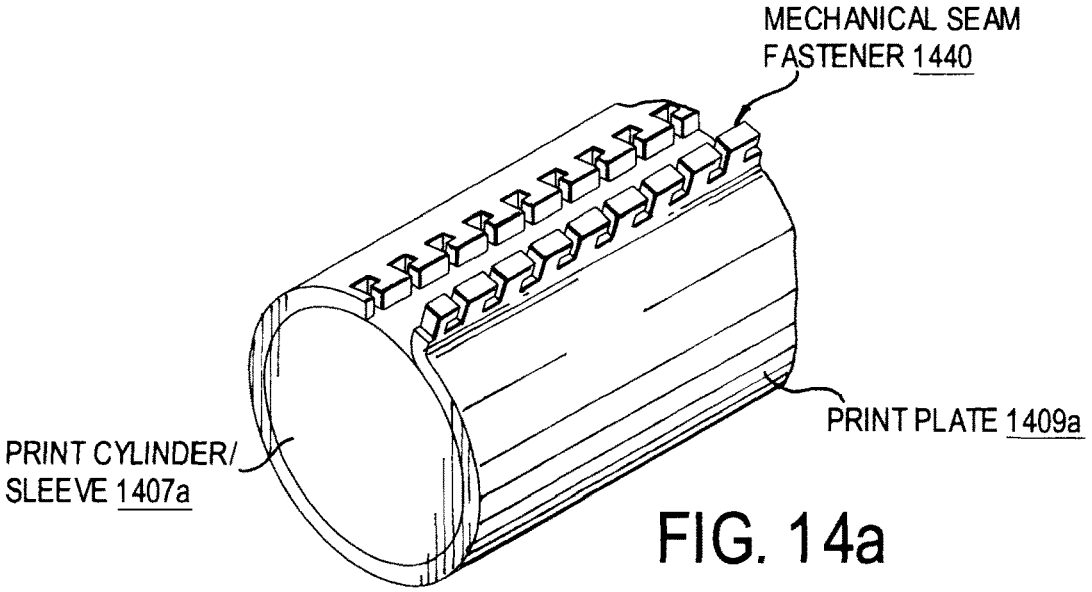
FIG. 14*a* illustrates a perspective view of a print plate mounting system configured to inhibit seam peeling of a mounted print plate, in accordance with an embodiment of the present disclosure.

FIG. 14*a* illustrates a perspective view of a print plate mounting system configured to inhibit seam peeling of plate, in accordance with an embodiment of the present disclosure. As can be seen, the system includes a print plate 1409*a* bonded to the print cylinder/sleeve 1407*a* using, for example, a double-sided foam tape layer as normally done. However, in addition, the plate 1409*a* is further configured with complementary mechanical seam fasteners 1440 at its edges that meet once installed on the print cylinder/sleeve 1407*a*. The mechanical seam fasteners 1440 can be implemented with any of the mechanical bonding techniques provided herein, so as to inhibit edge lifting of the plate 1409*a*.

Figure 14B:
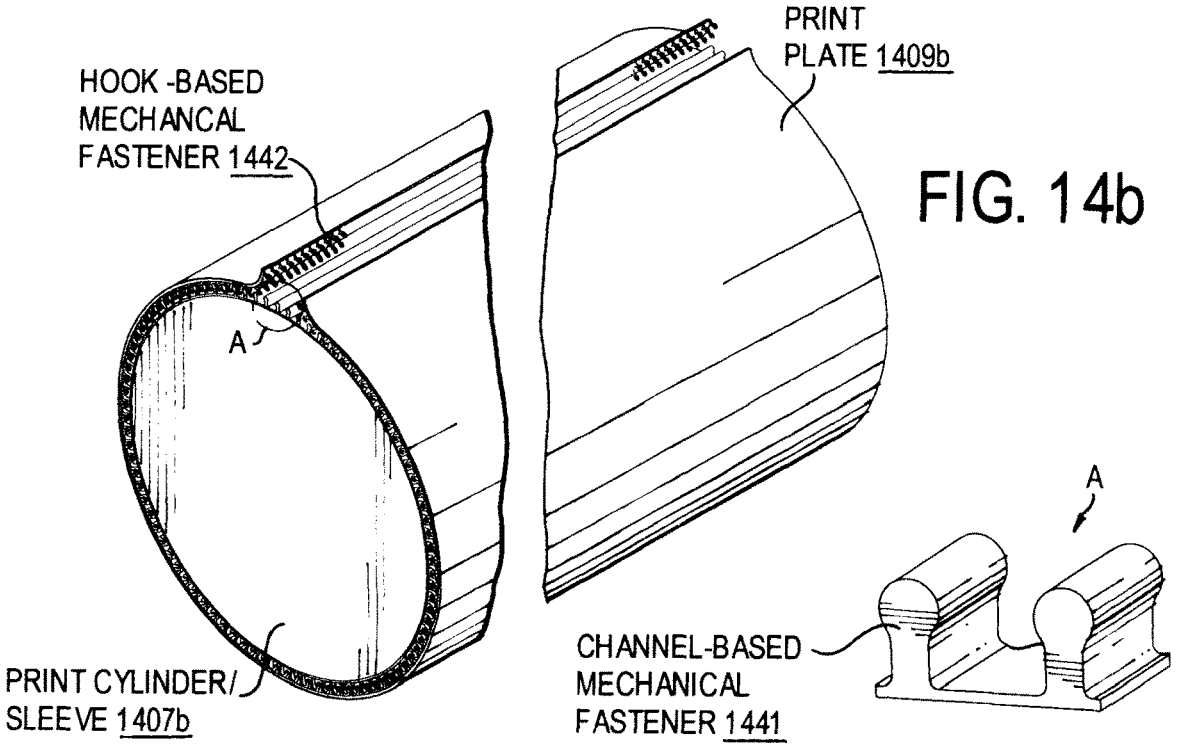

As will be appreciated in light of this disclosure, hook-and-hook and hook-to-channel, and channel-to-channel mechanical bonds can be used at any location of the plate mounting systems provided herein. Such mechanical bonds can also be strategically used in problem areas susceptible to peeling or poor print quality, such as the seam and edges of the print plate. For instance, FIG. 14*b* illustrates a perspective view of a print plate mounting system configured with channel-based mechanical fasteners, in accordance with an embodiment of the present disclosure. As can be seen, the print plate 1409*b* is configured with a hook-based mechanical fastener 1442 provisioned near the plate seam as shown. The plate 1409*b* is bonded to the print cylinder/sleeve 1407*b*, which is configured with a channel-based mechanical fastener 1441 provisioned near the plate seam as shown. Other parts of the cylinder can also include mechanical bonding elements or not. FIG. 14*c* illustrates an example channel-to-channel bond, in accordance with an embodiment of the present disclosure. In this example, each of plate 1409*c* and print cylinder/sleeve 1407*c* includes channel-based mechanical fasteners 1443 that interlockingly engage as shown (not drawn to scale). As will be further appreciated in light of this disclosure, such hook-to-channel and channel-to-channel bonding schemes provide a relatively low-profile closure that may resist plate peeling to a greater extent than traditional mounting tapes. Again, such bonding schemes can be used over the entire plate or more selectively such as near problem peeling areas (plate edges) and/or underneath or otherwise near print design areas that benefit from such tight mechanical bonds. Cushioning can be added to any such bonds, as provided herein, whether integrally within the mechanical bond itself or externally such as shown in FIG. 5*d*.

Plate Mounting Systems with Integral Cushion

FIGS. 15*a-c* illustrate perspective and cross-sectional views of an example loop-based mechanical bonding surface having an integral cushion effect that can be used in a print plate mounting system, in accordance with an embodiment of the present disclosure. As can be seen, the bonding surface includes a loop field 1573 and a cushion material 1575. The loop field 1573 can be any loop field, including those examples shown in FIGS. 4*a-l*. The cushion material 1575 can be, for example, a foam layer that effectively encases the loops. As can be seen in FIG. 15*b*, the cushion material 1575 may completely cover the loop field 1573, while FIG. 15*c* shows an embodiment where the cushion material 1575 only partially covers the loop field 1573 so that the loop tips can be seen even when the cushion material 1575 is uncompressed. In an alternative embodiment, the corresponding hook field (not shown) can be encased in cushion material 1575 and the loop field 1573 is not encased. In any such cases and as will be appreciated in light of this disclosure, the cushion material 1575 acts as a thickness stabilizer and helps to reduce backlash of the hook-loop bond. In addition, note that the cushion material 1575 can be engineered to provide a degree of desired hardness (e.g., soft, medium, hard) to suit a given print process.

FIG. 16 illustrates a cross-sectional view of a hook field 1677 engaging loops of loop field 1678, which is partially covered by cushion material 1675, in accordance with an embodiment of the present disclosure. Likewise, FIG. 17 illustrates a cross-sectional view of a hook field 1779 engaging hooks of hook field 1780, which is partially covered by cushion material 1775, in accordance with another embodiment of the present disclosure. In general, when a hook is engaged, it displaces the cushion material (1575, 1675, 1775), which effectively acts as a spring and also traps the hook in a fixed position. Further details of how to provision a field of foam over a hook field (or loop field, as the case may be) are provided in U.S. Pat. No. 7,108,814, which is herein incorporated in its entirety by reference. As will be further appreciated in light of this disclosure, the same techniques provided in U.S. Pat. No. 7,108,814 can be used to provide a cushion material 1575 over a field of hooks or loop or mechanical fastener provided herein to provide an integral cushion effect.

Note that, as used herein, a unidirectional hook field may have a plurality of hooks facing in the same direction, but yet a relatively small or otherwise targeted percentage of the hooks in that field may be facing in a different direction. This variance may be intentional (targeted) or unintentional (due to factors such as manufacturing oversight or unforeseen conditions, or otherwise). In some embodiments, the percentage of hooks facing in the same direction in a unidirectional hook field is about 50% or higher. In other embodiments, the percentage of hooks facing in the same direction in a unidirectional hook field is about 85% or higher, in some embodiments. In still other embodiments, the percentage of hooks facing in the same direction in a unidirectional hook field is about 95% or higher, in some embodiments. In one specific embodiment, 100% of the hooks in the unidirectional hook field are facing in the same direction. By 'same direction' it is meant that the hooks are within +/−25% of a target direction, or +/−20% of a target direction, or +/−15% of a target direction, or +/−10% of a target direction, or within +/−5% of a target direction, or within +/−2% of a target direction, or within +/−1% of a target direction in some embodiments. Thus, a precise same direction is not required, as will be appreciated.

Figure 18A:
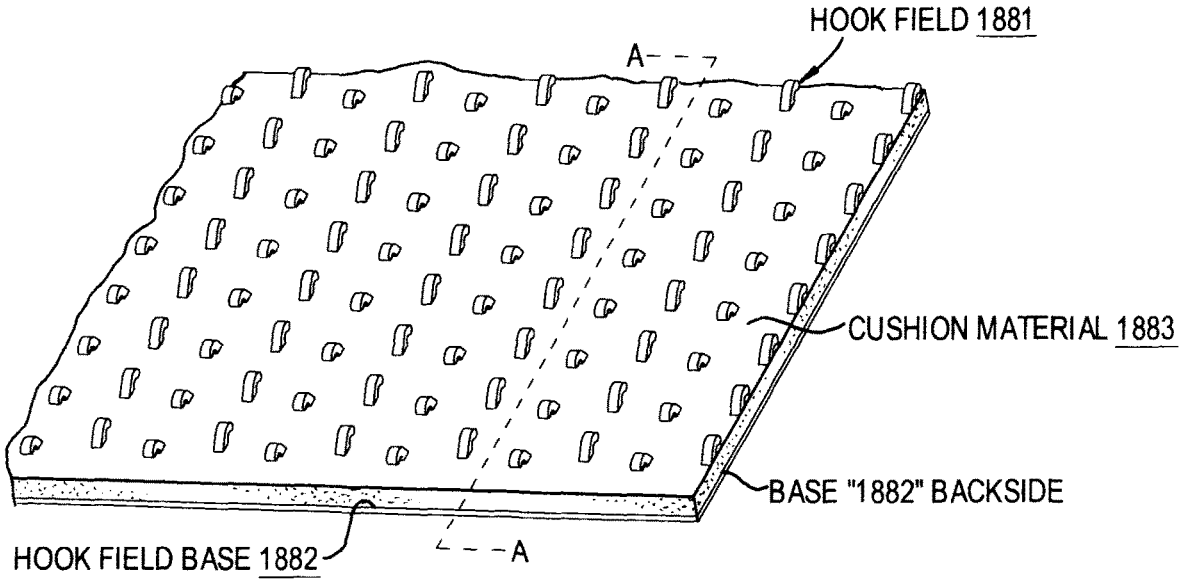
FIGS. 18*a-c* illustrate perspective and cross-sectional views of an example hook-based mechanical bonding surface having an integral cushion effect for use in a print plate mounting system, in accordance with another embodiment of the present disclosure.
Figure 18B:
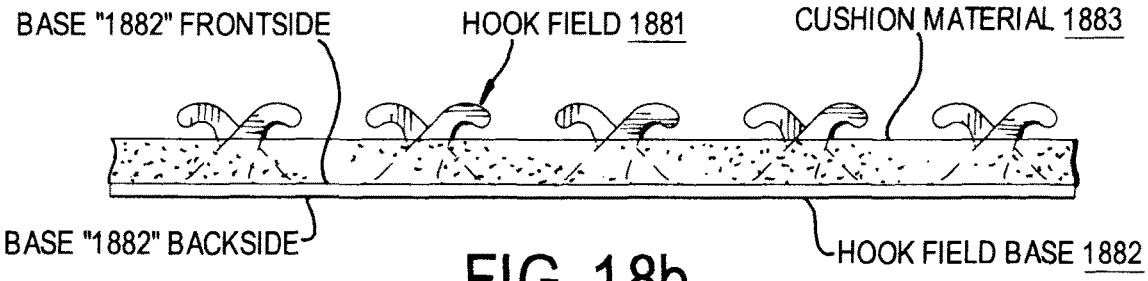
Figure 18C:
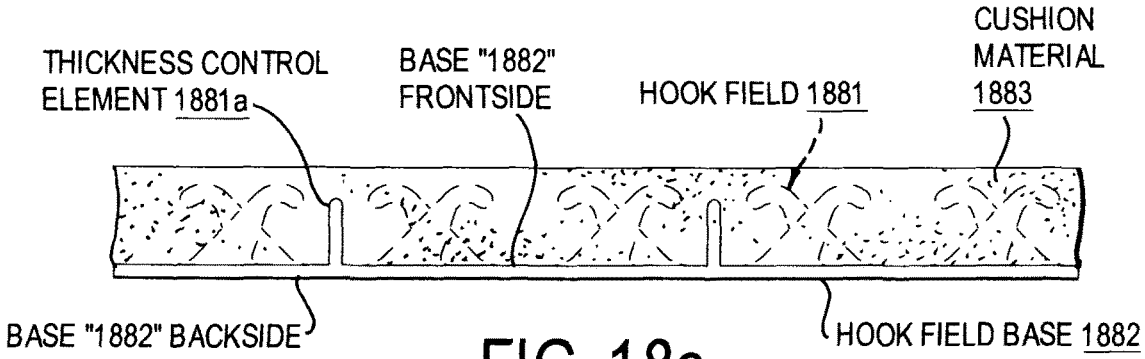

FIGS. 18*a-c* illustrate perspective and cross-sectional views of an example hook-based mechanical bonding surface having an integral cushion effect that can be used in a print plate mounting system, in accordance with another embodiment of the present disclosure. As can be seen in this example embodiment, the hooks of hook field 1881 are angled and J-shaped and formed in an alternating pattern, wherein about 50% of the hooks are facing in a first direction and the other 50% are facing in some other direction or directions (in this example case, opposite the first direction). The bi-directional alternating nature of the depicted hook field 1881 may provide comparable function to a unidirectional field but further allow additional flexibility in the mounting process. In one such bi-directional configuration, for instance, the hooks of hook field 1881 are either facing the same direction as the machine direction or opposite the machine direction, which will be true regardless of whether the hook field 1881 is on the print plate or the print cylinder/sleeve. As can be further seen, the hooks of hook field 1881 extend from a base 1882 having a front-side and a backside. As will be appreciated, the base 1882 can be formed during the same extrusion/mold process that forms the hooks of hook field 1881. In the example embodiment shown, a cushion material 1883 is provided on the front-side of base 1882. The cross-section of FIG. 18*b*, which is taken across section line A-A of FIG. 18*a*, shows the cushion material 1883 only partially covering the hook field 1881 so that the hook tips can be seen even when the cushion material 1883 is uncompressed. FIG. 18*c* shows an alternate embodiment where the cushion material 1883 is completely covering the hook field 1881, and further includes a number of thickness control elements 1881*a*. In either case, the rigidity of the hooks can be greater than the rigidity of the cushion material 1883, so that the hooks can operably engage with a complementary mechanical fastener (e.g., low-profile single level loop, or dual-level loop) during the mounting process and the cushion material 1883 provides an integral cushion effect. In the example embodiment depicted in FIG. 18*c*, the thickness control elements 1881*a* can be even more rigid than the hook elements and are generally designed to not engage with loops or other mechanical fasteners. Rather, in this example case, the thickness control elements 1881*a* will bottom out on the front-side of the base of the opposing mechanical fastener field (not shown) and will not yield or bend. The hooks 1881 and cushion material 1883, on the other hand, may yield or compress under pressure at least to the point where the thickness control elements 1881*a* engage. Such thickness control elements can be used in any of the various mechanical bonds provided herein. Numerous configurations and variations will be apparent in light of this disclosure.

Figure 19A:
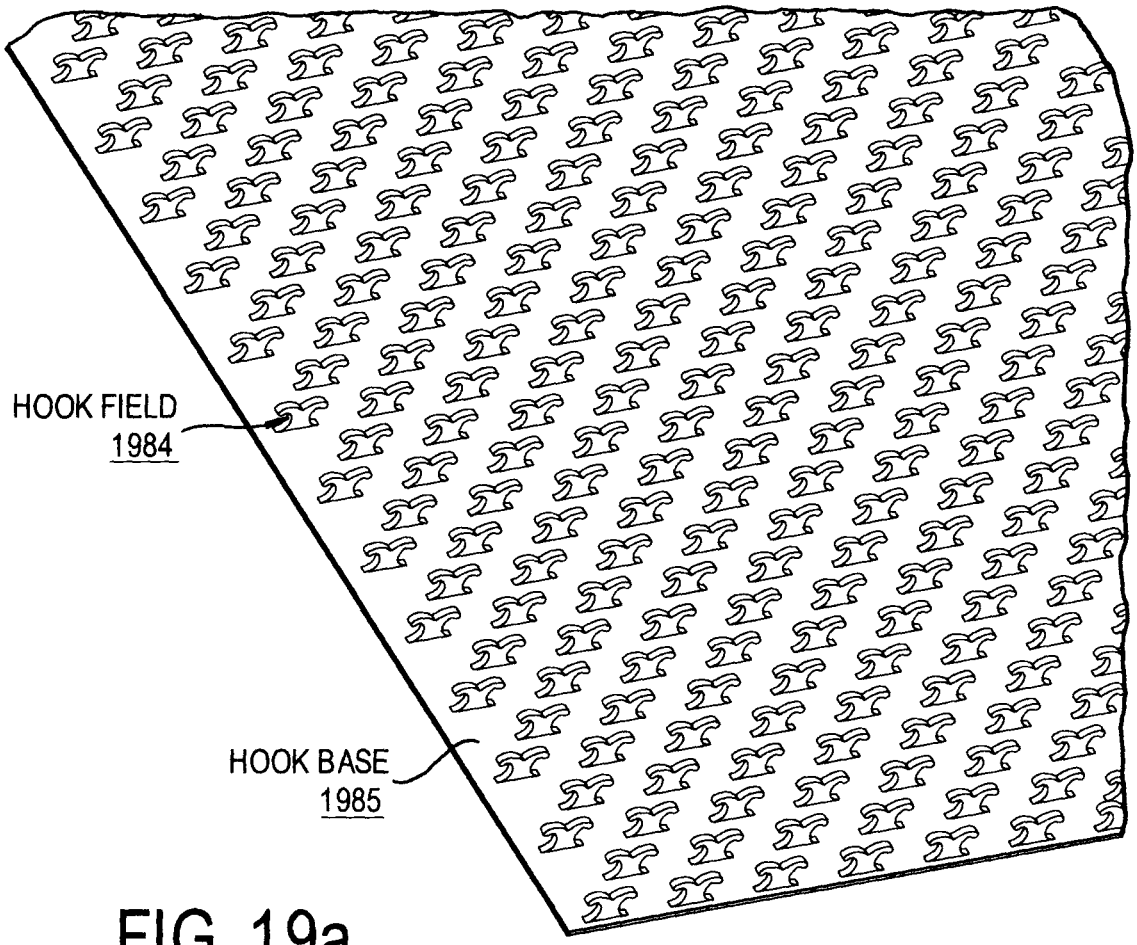
FIGS. 19*a-b* illustrate perspective and cross-sectional views of an example hook-based mechanical bonding surface having an integral cushion effect for use in a print plate mounting system, in accordance with another embodiment of the present disclosure.
Figure 19B:
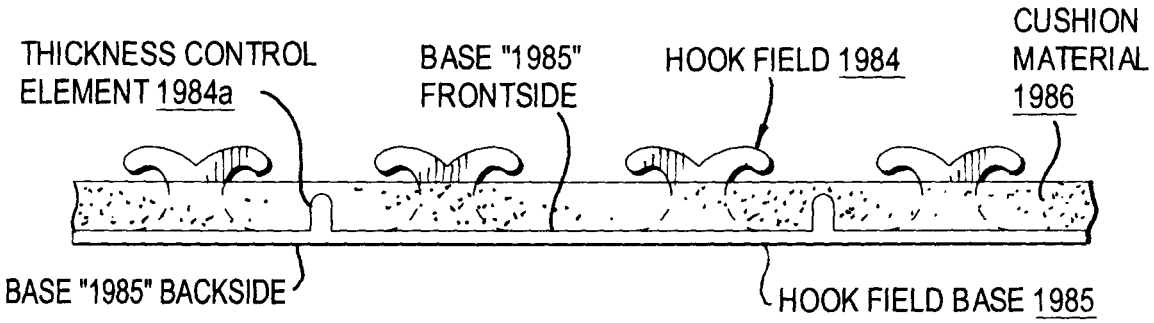

FIGS. 19*a-b* illustrate perspective and cross-sectional views of an example hook-based mechanical bonding surface having an integral cushion effect that can be used in a print plate mounting system, in accordance with another embodiment of the present disclosure. As can be seen in this example embodiment, the hooks of hook field 1984 are palm-tree shaped and formed in an alternating offset pattern on the front-side of base 1985, wherein every other row is effectively indented (other layout configurations can be used, as will be appreciated). As previously explained, the palm-tree shaped hooks may be configured for trapping an amount of loop to provide a cushion effect in some embodiments, while in other embodiments the palm-tree shaped hooks may be configured for poking through perforations provided in the base of the opposing mechanical fastener field (not shown). In the latter case, an integral cushion effect can be provided by cushion material 1986. FIG. 19*b* shows the cushion material 1986 partially covering the hook field 1984, but other embodiments may have the cushion material 1986 completely covering the hook field 1984. In either case, the rigidity of the hooks can be greater than the rigidity of the cushion material 1986, so that the hooks can operably engage or otherwise penetrate a complementary perforation during the mounting process and the cushion material 1986 provides an integral cushion effect. The palm-tree hook heads (or at least the tall ones, in a dual hook height configuration) penetrate through the perforations/punctures during initial mounting compression, and upon release of that compression, the hook heads catch on the underside of the opposing base. The cushion material 1986 may therefore remain in a compressed state, in some such cases, until an appropriate and intentional plate removal (dismount) force is provided. As can be further seen in FIG. 19*b*, the hook field 1984 may include a number of thickness control elements 1984*a* which are sufficiently rigid and allow the resilience of the hooks and cushion material 1986 to operate, but only to a certain degree (no further compressibility once the thickness control elements 1984*a* engage the base of the opposing fastener field). As will be appreciated, the resilience and geometries of the hook field 1984, thickness control elements 1984*a*, cushion material 1986, and the base of the opposing fastener field (not shown) operate together to define the overall thickness of the closure and to provide a managed compressibility.

FIGS. 20*a-c* illustrate perspective and cross-sectional views of an example hook-based mechanical bonding surface having an integral cushion effect that can be used in a print plate mounting system, in accordance with another embodiment of the present disclosure. As can be seen in this example embodiment, the hooks of hook field 2087 are mushroom or nail-head shaped and formed in an alternating offset pattern on the front-side of base 2088 (any number of patterns can be used). Just as with the palm-tree shaped hooks, the mushroom shaped hooks may be configured for trapping an amount of loop to provide a cushion effect in some embodiments, while in other embodiments the mushroom shaped hooks may be configured for poking through perforations provided in the base of the opposing mechanical fastener field (not shown). In the latter case, an integral cushion effect can be provided by cushion material 2089. FIG. 20*a* shows the cushion material 2089 and its holes 2090 prior to engagement with hook field 2087. As will be appreciated in light of this disclosure, the cushion material 2089 can be formed integrally with the mushroom hooks or can be formed separately and then installed onto the mushroom hooks. Likewise, just as with other embodiments, the cushion material 2089 can partially or completely cover the hooks, and the hook field 2087 may further include any number of thickness control elements, as previously explained. The example embodiment shown in FIG. 20*c* shows the cushion material 2089 partially covering the hook field 2087, such that the hook heads are protruding from the uncompressed cushion material 2089. In any such cases, the hooks can operably engage or otherwise penetrate a complementary perforation of the opposing mechanical fastener base during the mounting process and the cushion material 2089 provides an integral cushion effect in a similar fashion as explained with respect to the palm-tree shaped hooks of FIGS. 19*a-b*.

Methodology

Figure 21:
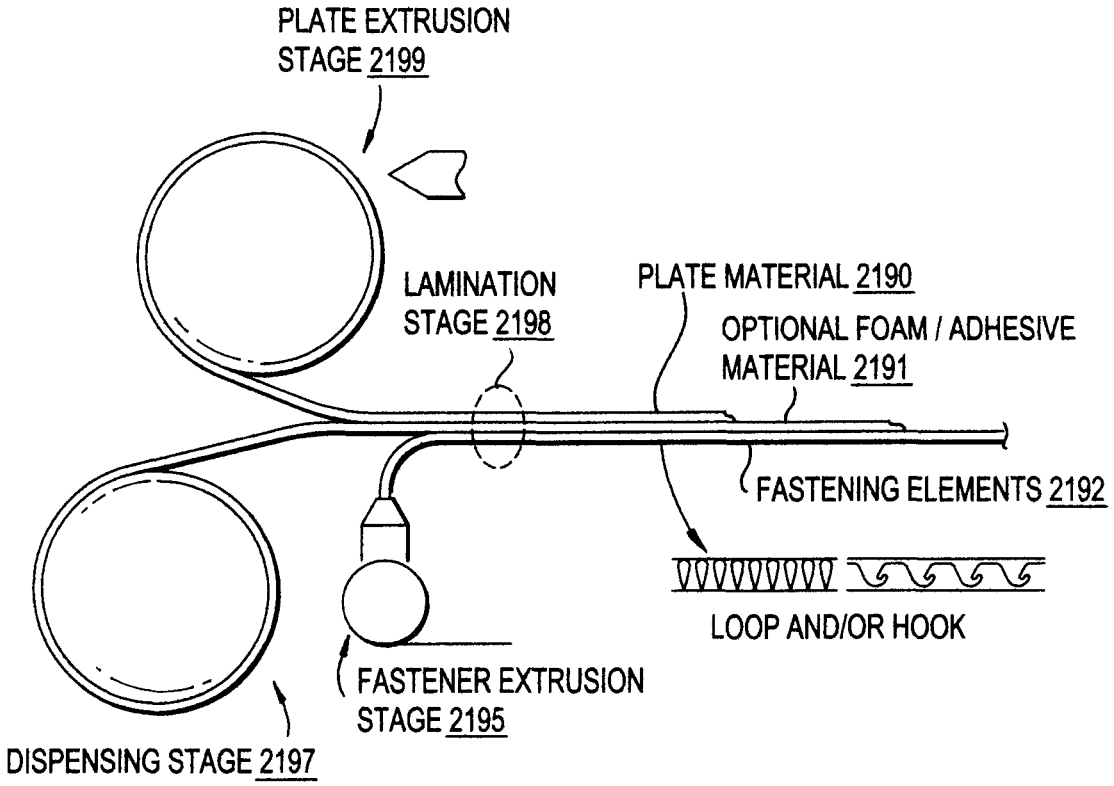
FIG. 21 illustrates a method for making a print plate having a built-in or otherwise integral mechanical fastener, in accordance with an embodiment of the present disclosure.

FIG. 21 illustrates a method for making a print plate having a built-in or integral mechanical fastener, in accordance with an embodiment of the present disclosure. As can be seen, the method generally includes a number of dispensing 2197 and extrusion stages 2195, 2199 that feed a lamination stage 2198 to produce the print plate having an integral field of fastening elements. In one example embodiment, the mechanical fastening elements 2192 are co-extruded with a plate material 2190 to provide the integrally formed arrangement. In such a case, the fastener extrusion stage 2195 and the plate extrusion stage 2199 operate together to provide the co-extruded plate with integral fastening elements 2192 and thus do not require the dispensing stage 2197 or lamination stage 2198. In another example embodiment, the mechanical fastening elements 2192 are over-extruded via the fastener extrusion stage 2195 onto a plate material 2190 to provide the integrally formed arrangement. In this case, note that the plate material 2190 may be a preformed plate, to some extent, and the fastener extrusion stage 2195 uses that preformed plate structure as a substrate upon which to extrude the mechanical fastening elements 2192. As will be appreciated in light of this disclosure, there may be one or more optional intervening layers 2191, such as a foam layer, an adhesive layer, an affinity-enhancing layer, or some combination thereof, which can be provided by one or more dispensing stages 2197. A subsequent lamination stage 2198 can be used to press and form the various layers together to further secure the extruded arrangement as an integral structure. Further details of how to extrude mechanical fasteners onto a backing or given substrate are provided in U.S. Pat. No. 5,260,015, which is herein incorporated in its entirety by reference. As will be further appreciated in light of this disclosure, the same techniques provided in U.S. Pat. No. 5,260,015 can be used to provide a print plate material 2190 as the substrate that is in-situ laminated with hooks and/or loops formed directly on a surface.

In the example embodiment shown, the mechanical fastening elements 2192 are depicted as hook and/or loop elements. In some such embodiments, the mechanical fastening elements 2192 are unidirectional hooks angled so as to lean in a direction that is generally opposite to the machine direction. In one such case, an intervening layer of foam material 2191 is extruded over the resulting unidirectional hook field 2192, to provide an integral cushion effect. Further details of how to provision a field of foam over a fastener field are provided in the previously incorporated U.S. Pat. No. 7,108,814. In another such case, the resulting unidirectional hook field 2192 is configured with flexible hook stems, to provide an integral cushion effect. In other embodiments, the mechanical fastening elements 2192 are a field of single height loops configured to engage a unidirectional hook field of the print cylinder/sleeve. In another such embodiment, the mechanical fastening elements 2192 are a field of dual-height loops configured to engage a unidirectional hook field of the print cylinder/sleeve, wherein the hooks engage with the lower loops and the upper loops provide an integral cushion effect. In another such embodiment, the mechanical fastening elements 1892 are a field of dual-height unidirectional hooks configured to engage another field of dual-height unidirectional hooks of the print cylinder/sleeve. In another such embodiment, the mechanical fastening elements 2192 are a field of dual-height unidirectional hooks configured to engage a field of dual-height loops of the print cylinder/sleeve. In other embodiments, the mechanical fastening elements 2192 comprise both hook-and-loop fields configured to engage complementary fields of the print cylinder/sleeve. Numerous such variations will be apparent in light of this disclosure. In any such cases, the fastener fields used in forming the mechanical bond (or some sub-set of those fastener fields) can be configured with an integral cushion effect as provided herein. Cushioning external to the mechanical bond may be provided as well, to either supplement the integral cushion effect or as the sole cushioning. Note that 'external' cushioning refers to cushioning that is not between the bases of the two interfacing fasteners of the mechanical bond, such as shown in FIG. 5*d*.

In still other embodiments, the mechanical fastening elements 2192 comprise other mechanical fasteners, such as channels or ridges or other such grabbing elements that can be molded or otherwise extruded and used in a male-female engagement to secure and/or self-align the print plate to a given print cylinder or sleeve. As will be further appreciated, a combination of mechanical fastening elements may be used as well, such as hooks and ridge, or hooks, channels, and loop. In any such cases, the extrusion, lamination, and molding techniques provided herein or otherwise referenced can be used to form the integrally formed structure, including methods provided in the previously incorporated U.S. Pat. Nos. 5,260,015, 6,687,962, 7,108,814, 8,225,467, 8,448,305, and 8,685,194, as well as U.S. Patent Publication Nos. 2013/0239371, 2013/0280474, and 2013/0318752.

Note that the depiction shown in FIG. 21 is not intended to implicate any particular limitations on the process tool set-up. In other words, while the dispensing and extrusion stages are generally shown in a particular vertical orientation, numerous other orientations and stage layout schemes will be apparent in light of this disclosure. For instance, another embodiment may generally provide for a lower level plate extrusion stage 2199 and an upper level fastener extrusion stage 2195. Alternatively, another embodiment may generally provide for a more horizontal arrangement having a plate extrusion stage 2199 followed by a fastener extrusion stage 2195. In one such case, an intervening stage between the extrusion stages can be provided to, for instance, form an affinity-enhancing layer on the plate material 2190 so as to facilitate bonding of the mechanical fastener material 2192 to the plate material 2190 during a subsequent lamination stage. Alternatively, or in addition to, a subsequent stage may follow the fastener extrusion stage 2195 for provisioning an integral foam layer over the mechanical fastener field 2192. Note that this foam deposition stage can be before or after the lamination stage 2198. Further note that some embodiments may be completely free of any intervening adhesives, given sufficient affinity between the materials being laminated to form the integral structure. Numerous variations will be apparent.

Further Example Embodiments

The following examples pertain to further embodiments, from which numerous permutations and configurations will be apparent.

Example 1 is a fastening system for mounting a print plate to a print cylinder, comprising: a first field of mechanical fasteners on one side of the print plate, the other side of the print plate for carrying a print design in relief; and a second field of mechanical fasteners for placement on or integration with the print cylinder. The first and second fields of mechanical fasteners operate together to provide a mechanical bond that inhibits lateral and rotational movement of the plate during printing operations, and is configured to manage backlash between engaging surfaces of the mechanical bond by way of at least one of a field of unidirectional fastening elements and a cushion effect integral with the mechanical bond itself.

Example 2 includes the subject matter of Example 1, wherein at least one of the first or second fields of mechanical fasteners comprises a field of unidirectional hooks.

Example 3 includes the subject matter of Example 2, wherein the unidirectional hooks are angled according to machine direction.

Example 4 includes the subject matter of Example 2 or 3, wherein the field of unidirectional hooks is provided on the print cylinder.

Example 5 includes the subject matter of any of Examples 2 through 4, wherein the field of unidirectional hooks is provided on the print plate.

Example 6 includes the subject matter of any of Examples 2 through 5, wherein the unidirectional hooks lean in a first direction, the system further comprising a second field of unidirectional hooks that lean in a second direction that is opposite the first direction.

Example 7 includes the subject matter of any of Examples 2 through 6, wherein the field of unidirectional hooks is at least partially covered in a cushion material that provides at least part of the cushion effect integral with the mechanical bond itself.

Example 8 includes the subject matter of any of the previous Examples, and further includes a cushion layer external to the mechanical bond that provides additional cushion effect.

Example 9 includes the subject matter of any of the previous Examples, and further includes a cushion layer integral with the mechanical bond that provides at least part of the cushion effect integral with the mechanical bond itself.

Example 10 includes the subject matter of any of the previous Examples, wherein one of the first or second fields of mechanical fasteners comprises hooks configured with flexible stems to resistively deform during at least one of engagement with the opposing mechanical fastener field and print operations, thereby providing at least part of the cushion effect integral with the mechanical bond itself.

Example 11 includes the subject matter of any of the previous Examples, wherein one of the first or second fields of mechanical fasteners comprises an unnapped loop field.

Example 12 includes the subject matter of Example 11, wherein unnapped loop field comprises two levels so as to provide a short loop height and a tall loop height.

Example 13 includes the subject matter of Example 12, wherein the tall loop height provides at least part of the cushion effect and the loops having the short height engage with a complementary hook field.

Example 14 includes the subject matter of any of the Examples 11 through 13, wherein one of the first or second fields of mechanical fasteners comprises a spacer fabric configured with loop-like engageability or a loop pile on at least one surface, thereby providing at least part of the cushion effect integral with the mechanical bond itself.

Example 15 includes the subject matter of any of the previous Examples, wherein one of the first or second fields of mechanical fasteners comprises a loop field and the other field comprises a hook field.

Example 16 includes the subject matter of any of the previous Examples, wherein one of the first or second fields of mechanical fasteners comprises a male feature and the other field comprises a female feature.

Example 17 includes the subject matter of any of the previous Examples, wherein one of the first or second fields of mechanical fasteners comprises a magnet and the other field comprises a surface to which a magnet can bond.

Example 18 includes the subject matter of any of the previous Examples, wherein one of the first or second fields of mechanical fasteners comprises a vacuum element and the other field comprises a surface to which a vacuum can bond.

Example 19 includes the subject matter of any of the previous Examples, wherein one of the first or second fields of mechanical fasteners comprises a suction cup and the other field comprises a surface to which a suction cup can bond.

Example 20 includes the subject matter of any of the previous Examples, wherein one of the first or second fields of mechanical fasteners comprises a first gear pattern and the other field comprises a second gear pattern that snugly engages with the first gear pattern.

Example 21 includes the subject matter of any of the previous Examples, wherein at least one of the first or second fields of mechanical fasteners is configured to prevent edge lifting of the plate.

Example 22 includes the subject matter of any of the previous Examples, wherein at least one of the first or second fields of mechanical fasteners comprises unidirectional hooks provisioned in an alternating pattern, such that a first row of hooks face in one direction and a next row of hooks face in another direction to provide a bi-directional or otherwise multi-directional hook field.

Example 23 includes the subject matter of any of the previous Examples, wherein at least one of the first or second fields of mechanical fasteners comprises unidirectional hooks, and wherein at least 85% of the hooks that field are facing in a target direction, plus or minus 15 degrees.

Example 24 is a print plate for a cylinder-based printing system, the plate comprising an integral field of mechanical fasteners that form a mechanical bond with a print sleeve or print cylinder having a corresponding field of mechanical fasteners. The plate may be configured, for instance, as variously indicated in any of the previous Examples 1 through 23.

Example 25 includes the subject matter of Example 24, wherein the print plate has a print side and a non-print side, the print side comprising a photopolymer material and the non-print side comprising a material that is laminated with the photopolymer material.

Example 26 is a print sleeve for a cylinder-based printing system, the plate sleeve comprising an integral field of mechanical fasteners that form a mechanical bond with a print plate having a corresponding field of mechanical fasteners. The print sleeve may be configured, for instance, as variously indicated in any of the previous Examples 1 through 23.

Example 27 includes the subject matter of Example 26, wherein the print sleeve is heat-shrinkable. Alternatively, the print sleeve may be elastic or otherwise stretchable.

Example 28 is a print cylinder for printing system, the cylinder comprising an integral field of mechanical fasteners that form a mechanical bond with a print plate having a corresponding field of mechanical fasteners, wherein at least part of the print cylinder and the integral field of mechanical fasteners are of a unitary mass of material. The print cylinder may be configured, for instance, as variously indicated in any of the previous Examples 1 through 23.

Example 29 is a method for forming a print plate for a cylinder-based printing system, the method comprising extruding a field of mechanical fasteners onto a print plate or a print plate blank. The print plate may be configured, for instance, as variously indicated in any of the previous Examples 1 through 25.

Example 30 includes a method for forming a print plate for a cylinder-based printing system, the method comprising co-extruding a field of mechanical fasteners and a print plate or print plate blank. The print plate may be configured, for instance, as variously indicated in any of the previous Examples 1 through 25.

Example 31 includes the subject matter of Example 29 or 30, further including laminating the structure resulting from the extrusion.

Example 32 includes the subject matter of any of Examples 29 through 31, further including forming a cushion layer over the field of mechanical fasteners.

Example 33 is a fastening system for mounting a print plate to a print cylinder, comprising: a first field of mechanical fasteners on one side of the print plate, the other side of the print plate for carrying a print design in relief; and a second field of mechanical fasteners for placement on or integration with the print cylinder. The first and second fields of mechanical fasteners operate together to provide a mechanical bond that inhibits lateral and rotational movement of the plate during printing operations, and is configured to manage backlash between engaging surfaces of the mechanical bond by way of unidirectional fastening elements. In addition, one of the first or second fields of mechanical fasteners comprises unidirectional hooks that are angled according to machine direction.

Example 34 includes the subject matter of Example 33, wherein the field of unidirectional hooks is at least partially covered in a cushion material.

Example 35 includes the subject matter of Example 33 or 34, further including a cushion layer integral with the mechanical bond.

Example 36 includes the subject matter of any of Examples 33 through 35, wherein the other one of the first or second fields of mechanical fasteners comprises an unnapped loop field.

Example 37 includes the subject matter of any of Examples 33 through 36, wherein at least 75% of the hooks of the first or second hook field are facing in a target direction, plus or minus 15 degrees.

Example 38 includes the subject matter of Example 37, wherein a percentage the hooks of the first or second hook field are facing in a direction opposite the target direction, plus or minus 15 degrees.

Example 39 is a print plate for a printing system, the plate comprising an integral field of mechanical fasteners that form a mechanical bond with a corresponding print machine element having a complementary field of mechanical fasteners. The print plate may be configured, for instance, as variously indicated in any of the previous Examples 1 through 25.

Example 40 includes the subject matter of Example 39, wherein the integral field of mechanical fasteners includes metal pieces embedded within the plate and proximate edges of the plate, and wherein concentration of the metal pieces at the edges is higher than a concentration of metal pieces elsewhere in the plate.

Example 41 includes the subject matter of Example 40, wherein the concentration of metal pieces elsewhere in the plate is less than 25 percent by volume.

Example 42 includes the subject matter of Example 40, wherein the concentration of metal pieces elsewhere in the plate is zero.

Example 43 includes the subject matter of Example 40, wherein the concentration of metal pieces elsewhere in the plate is in the range of 5 to 50 percent by volume, and the concentration of the metal pieces at the edges is in the range of 25 to 95 percent by volume.

Example 44 includes the subject matter of any of Examples 40 through 43, wherein at a given plate cross-section containing metal pieces, a remaining percent by volume not occupied by metal pieces is occupied by at least one of a photopolymer and cushion material.

Example 45 includes the subject matter of any of Examples 40 through 44, wherein the metal pieces comprise iron flake.

Example 46 includes the subject matter of any of Examples 39 through 45, wherein the integral field of mechanical fasteners are configured to provide at least two types of mechanical bonds, the types being selected from the group of hook-and-loop bond, hook-and-hook bond, hook-to-channel bond, male/female-type fitting bond, vacuum bond, suction bond, magnetic bond, and interlocking gear bond.

Example 47 includes the subject matter of any of Examples 39 through 46, wherein the integral field of mechanical fasteners is configured to provide a first mechanical bond proximate at least one edge of the plate and that first mechanical bond is stronger than bonds associated with other areas of the plate.

Example 48 includes the subject matter of Example 47, wherein the first mechanical bond is implemented with vacuum or suction and the bonds associated with other areas of the plate are implemented with magnetics.

Example 49 includes the subject matter of Example 47, wherein the first mechanical bond is implemented with magnetics and the bonds associated with other areas of the plate are implemented with vacuum or suction.

Example 50 includes the subject matter of Example 47, wherein the first mechanical bond is implemented with magnetics and the bonds associated with other areas of the plate are implemented with adhesive.

The foregoing description of example embodiments has been presented for the purposes of illustration and description. It is not intended to be exhaustive or to limit the disclosure to the precise forms disclosed. Many modifications and variations are possible in light of this disclosure. It is intended that the scope of the disclosure be limited not by this detailed description, but rather by the claims appended hereto.

What is claimed is:

1. A fastening system for mounting a print plate to a print cylinder, comprising:

a first field of integral mechanical fasteners on one side of the print plate, another side of the print plate for carrying a print design in relief, the first field including metal pieces embedded within the print plate and at proximate edges of the print plate, and wherein concentration of the metal pieces at the edges is higher than a concentration of metal pieces elsewhere in the print plate; and a second field of mechanical fasteners for placement on or integration with the print cylinder;

wherein the first and second fields of mechanical fasteners operate together to form a mechanical bond that inhibits lateral and rotational movement of the print plate during printing operations with respect to the print cylinder, at least one of the first or second fields of mechanical fasteners comprising a field of unidirectional hooks, the unidirectional hooks being angled according to the rotational movement of the print cylinder during printing operations.

2. The system of claim 1 wherein the field of unidirectional hooks is provided on the print cylinder.

3. The system of claim 1 wherein the field of unidirectional hooks is at least partially covered in a cushion material that provides at least part of a cushion effect integral with the mechanical bond itself.

4. The system of claim 1 further comprising a cushion layer integral with the mechanical bond that provides at least part of a cushion effect integral with the mechanical bond itself.

5. The system of claim 1 wherein one of the first or second fields of mechanical fasteners comprises hooks configured with flexible stems to resistively deform during at least one of engagement with the opposing mechanical fastener field and print operations, thereby providing at least part of a cushion effect integral with the mechanical bond itself.

6. The system of claim 1 wherein one of the first or second fields of mechanical fasteners comprises an unnapped loop field, wherein the unnapped loop field comprises first and second levels so as to provide a short loop height and a tall loop height.

7. The system of claim 6 wherein loops having the tall loop height provide at least part of a cushion effect and loops having the short loop height engage with a complementary hook field.

8. The system of claim 1 wherein one of the first or second fields of mechanical fasteners comprises a spacer fabric configured with loop-like engagebility or a loop pile on at least one surface, thereby providing at least part of a cushion effect integral with the mechanical bond itself.

9. The system of claim 1 wherein one of the first or second fields of mechanical fasteners comprises a loop field and the other field comprises a hook field.

10. The system of claim 1 wherein one of the first or second fields of mechanical fasteners comprises a first gear pattern and the other field comprises a second gear pattern that snugly engages with the first gear pattern.

11. The system of claim 1 wherein at least 85% of the hooks are facing in a target direction, plus or minus 15 degrees.

12. The system of claim 1 further comprising a ferromagnetic print cylinder sleeve configured to form a magnetic bond with the ferromagnetic pieces in the first field of mechanical fasteners.

13. A method for forming a print plate for a cylinder-based printing system, the method comprising one of extruding a field of mechanical fasteners onto a print plate or a print plate blank, or co-extruding a field of mechanical fasteners and a print plate or print plate blank, the field of mechanical fasteners including metal pieces embedded within the print plate and at proximate edges of the print plate, and wherein concentration of the metal pieces at the edges is higher than a concentration of metal pieces elsewhere in the print plate, the field of mechanical fasteners configured to form a mechanical bond with a corresponding print machine element having a complementary field of mechanical fasteners, the magnetic metal pieces forming a magnetic bond with corresponding magnetic elements in the print machine element, the mechanical and magnetic bonds inhibiting lateral and rotational movement of the print plate with respect to the print machine element during printing operations.

14. A print plate for a cylinder-based printing system formed by the method of claim 13, the print plate comprising an integral field of mechanical fasteners that form a mechanical bond with a print sleeve or print cylinder having a corresponding field of mechanical fasteners.

15. The print plate of claim 14 wherein the print plate has a print side and a non-print side, the print side comprising a photopolymer material and the non-print side comprising a material that is laminated with the photopolymer material.

16. A cylinder-based printing system including the print plate of claim 14 wherein the print sleeve comprises an integral field of mechanical fasteners that form a mechanical bond with a print plate having a corresponding field of mechanical fasteners.

17. The cylinder-based printing system of claim 16 wherein the print sleeve is heat-shrinkable.

18. A print plate for a printing system, the print plate comprising an integral field of mechanical fasteners that form a mechanical bond with a corresponding print machine element having a complementary field of mechanical fasteners, wherein the integral field of mechanical fasteners includes metal pieces embedded within the print plate and proximate edges of the print plate, and wherein concentration of the metal pieces at the edges is higher than a concentration of metal pieces elsewhere in the print plate.

19. The print plate of claim 18 wherein the integral field of mechanical fasteners are configured to provide at least two types of mechanical bonds, the types being selected from the group of hook-and-loop bond, hook-and-hook bond, hook-to-channel bond, male/female-type fitting bond, vacuum bond, suction bond, magnetic bond, and interlocking gear bond.

20. The print plate of claim 18 wherein the integral field of mechanical fasteners is configured to provide a first mechanical bond proximate at least one edge of the print plate and that first mechanical bond is stronger than bonds associated with other areas of the print plate.

* * * * *